United States Patent [19]

Tanaka

[11] Patent Number: 4,724,656

[45] Date of Patent: Feb. 16, 1988

[54] AUTOMATIC MOLTEN SUBSTANCE BAGGING SYSTEM

[76] Inventor: Sokichi Tanaka, 1106 Noa-Shibadaimon, 4-4, Shiba-Daimon 1-chome, Minato-ku, Tokyo, Japan

[21] Appl. No.: 897,953

[22] Filed: Aug. 19, 1986

[30] Foreign Application Priority Data

Oct. 2, 1985 [JP] Japan ..... 60-217985

[51] Int. Cl.[4] ..... B65B 3/32; B65B 3/24

[52] U.S. Cl. ..... 53/502; 53/240; 141/83; 141/128

[58] Field of Search ..... 53/240, 502; 141/83, 141/128, 10, 67, 68, 114, 317, 316, 315, 314, 313

[56] References Cited

U.S. PATENT DOCUMENTS

| | | | |
|---|---|---|---|
| 2,651,443 | 9/1953 | Carter | 53/240 |
| 3,152,622 | 10/1964 | Rothermel | 141/83 |
| 3,416,620 | 12/1968 | McClusky | 53/502 X |
| 3,498,020 | 3/1970 | Eppenberger | 141/83 X |
| 4,074,507 | 2/1978 | Ruf et al. | 141/83 X |
| 4,275,775 | 6/1981 | Egli | 141/83 |
| 4,523,616 | 6/1985 | Kleinophorst et al. | 141/83 |

FOREIGN PATENT DOCUMENTS

| | | | |
|---|---|---|---|
| 1092565 | 12/1980 | Canada | 53/240 |

*Primary Examiner*—James F. Coan

*Attorney, Agent, or Firm*—Sughrue, Mion, Zinn, Macpeak and Seas

[57] ABSTRACT

An automatic molten substance bagging system which can fill a molten substance such as asphalt latex into a bag in a short period of time fully automatically without operation by hand. A bag is first supplied into a carrying can on a circulating conveyor system and is inflated with air. Then, the bag is filled rapidly with a fixed volume of a molten substance and then further filled moderately with the molten substance until a predetermined weight is reached. The thus filled up bag is sealed at a mouth thereof by a sewing machine, and finally a plurality of such filled up, sealed bags are transferred onto another conveyor for further processing while their carrying cans are left on the circulating conveyor system so as to repeat such a sequence of operations for further bags.

7 Claims, 37 Drawing Figures

8
19
22
24
20
23
22
21
25
25
30
31
29
28
27
26
26a
15
16
15
18
15
17
31a
37
39
40
38
15
39
40
15
36
42
41
15
43
44
15
1
33

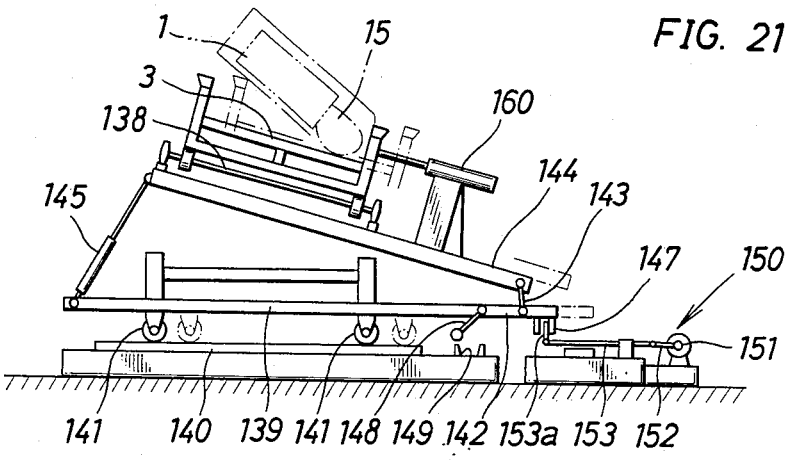
FIG. 21
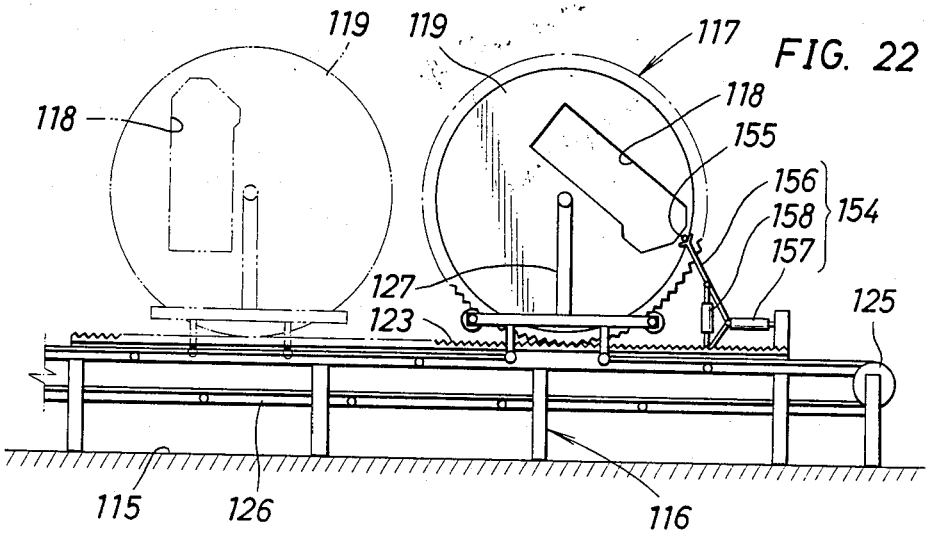
FIG. 22
FIG. 23
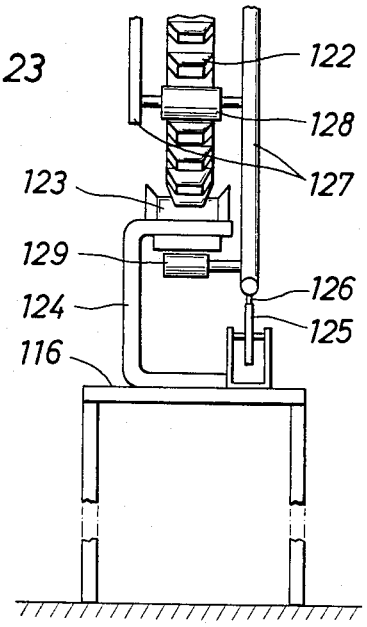

176

179

180

AUTOMATIC MOLTEN SUBSTANCE BAGGING SYSTEM

BACKGROUND OF THE INVENTION

This invention relates to an automatic molten substance bagging system for automatically bagging a molten substance such as asphalt latex or bitumen.

Asphalt latex or bitumen is filled into paper bags in a plant and kept in custody and shipped therefrom. Such paper bags are first fed one by one into a carrying can made of a metal material with their peripheries folded inside over themselves in flattened conditions, and while held contained in the carrying cans, they are fed by a conveyor into an inflator (a bag inflating apparatus) by which they are inflated. Then, they are transported by another conveyor to a position below a filling apparatus by which they are filled with asphalt latex to a predetermined fixed weight, and then they are transported to a sealing position at which they are sealed by means of a sewing machine. After that, they are transferred onto a pallet from the carrying cans and then transported to a storage place together with the pallet by a further conveyor.

Conventionally, when asphalt latex is to be filled into a paper bag, at first a mouth of a paper bag contained in a carrying can is manually opened, and then with the mouth of the paper bag held open, the carrying can is put on a weighing instrument and asphalt latex is filled into the paper bag while measuring the weight including the carrying can.

Such an operation is dangerous (since asphalt latex is at a high temperature above 200 degrees centigrade) and requires much labor, hindering the full automation of the system. Besides, since the weight is measured continuously from an initial stage of pouring the asphalt latex until the completion of such pouring by a predetermined fixed weight, much time is required for such measurement.

Meanwhile, in an operation for feeding a paper bag into a carrying can, bags folded on themselves in flattened conditions and accumulated in a heap are separated and taken out one by one by hand and are inserted into carrying cans by hand with their bottom sides directed downwardly.

Accordingly, much time is required for such operation, having an influence on subsequent operations such as a filling operation.

Further, in a conventional dumping apparatus, as disclosed in Japanese patent publication No. 40-4878, a trippler is advanced while being rotated to tilt and move a carrying can to a position above a pallet and is then retracted while being rotated back to move back the carrying can, thereby allowing a paper bag (filled up with asphalt latex and sealed) to be pulled out of the carrying can and transferred onto the pallet.

However, because the conventional dumping apparatus transfers a paper bag while a pallet having the paper bag contained therein is held in a horizontal condition at a predetermined position, it has the following drawbacks.

In particular, when a carrying can is tilted until its opening is directed downwardly, since asphalt latex filled in a paper bag has much weight and still remains in a molten state at a high temperature, asphalt latex will flow to one side and inflate or swell an end portion (upper end portion) of the paper bag which extends outwardly from the opening of the carrying can, and due to a partial load caused thereby, the paper bag will be largely curved adjacent an edge of the opening of the carrying can and will be dropped at its inflated end portion thereof onto a horizontal pallet while it is slidably engaged with the opening edge of the carrying can. After that, upon returning upward movement of the carrying can, the paper bag is pulled out of the carrying can while being lifted by the opening edge of the carrying can. Accordingly, not only a shock upon dropping of the end portion of the paper bag is great but also the stress of lifting by the opening edge of the carrying can is high so that it may be damaged by such a great shock and a high stress additionally due to a fact that it can be readily damaged due to the heat of asphalt latex. As a result, it often occurs that asphalt latex leaks from paper bags and soils pallets and some other paper bags, resulting in the interruption of an operation.

SUMMARY OF THE INVENTION

It is an object of the present invention to provide an automatic molten substance bagging system which can fill a molten substance such as asphalt latex into a bag in a short period of time fully automatically without the necessity of operation by hand.

It is another object of the invention to provide an automatic molten substance bagging system wherein operations for throwing a bag into a carrying can are automated.

It is a further object of the invention to provide an automatic molten substance bagging system which can minimize a shock upon transferring of a filled up sealed paper bag from a carrying can onto a pallet and a stress applied by returning movement of a carrying can, and which can reduce the operation time as a whole, can bag efficiently, and can store them without any trouble.

According to the present invention, an automatic molten substance bagging system comprises a conveyor system providing a substantially closed path for circulating carrying cans adapted to receive bags therein, an automatic bag supply apparatus for supplying a bag into each of the carrying cans, an inflator for automatically opening a mouth of and inflating the bag received in each of the carrying cans, an automatic filling apparatus for filling up the thus inflated bag with a predetermined weight of a molten substance, the filling apparatus including first means for first filling the bag with a fixed volume of the molten substance, the fixed volume corresponding to most of the predetermined weight of the molten substance, the filling apparatus further including second means for weighing the bag and for further filling the bag with the molten substance until the predetermined weight of the molten substance is reached, a sealing apparatus for sealing the mouth of the bag filled up with the molten substance, and a dumping apparatus for transferring a plurality of the filled up, sealed bags onto another conveyor system for further processing while leaving the carrying cans on the first-mentioned conveyor system. Thus, since a molten substance such as asphalt latex or bitumen is first filled by volume at a stroke, for example, to 90 percent of a prescribed fill-up amount (prescribed weight) into a bag and is then automatically filled moderately for the remaining 10 percent or so into the bag while the weight is being measured until the prescribed weight is reached, the molten substance such as asphalt latex can be bagged in a short period of time fully automatically without operations by hand.

BRIEF DESCRIPTION OF THE DRAWINGS

FIG. 3 is a perspective view, in an enlarged scale, of a carrying can in which a paper bag is fed in;

FIG. 21 is a side elevational view of a mechanism of the dumping apparatus of FIG. 19 for moving back and forth and slanting a pallet positioning conveyor;

FIG. 22 is a side elevational view of a tippler rolled to a forward limit position;

FIG. 23 is an enlarged cross sectional view of a mechanism for rolling the tippler of FIG. 22;

DETAILED DESCRIPTION OF THE PREFERRED EMBODIMENTS

Now, the present invention will be described in more detail in conjunction with preferred embodiments thereof with reference to the accompanying drawing.

Figure 1:
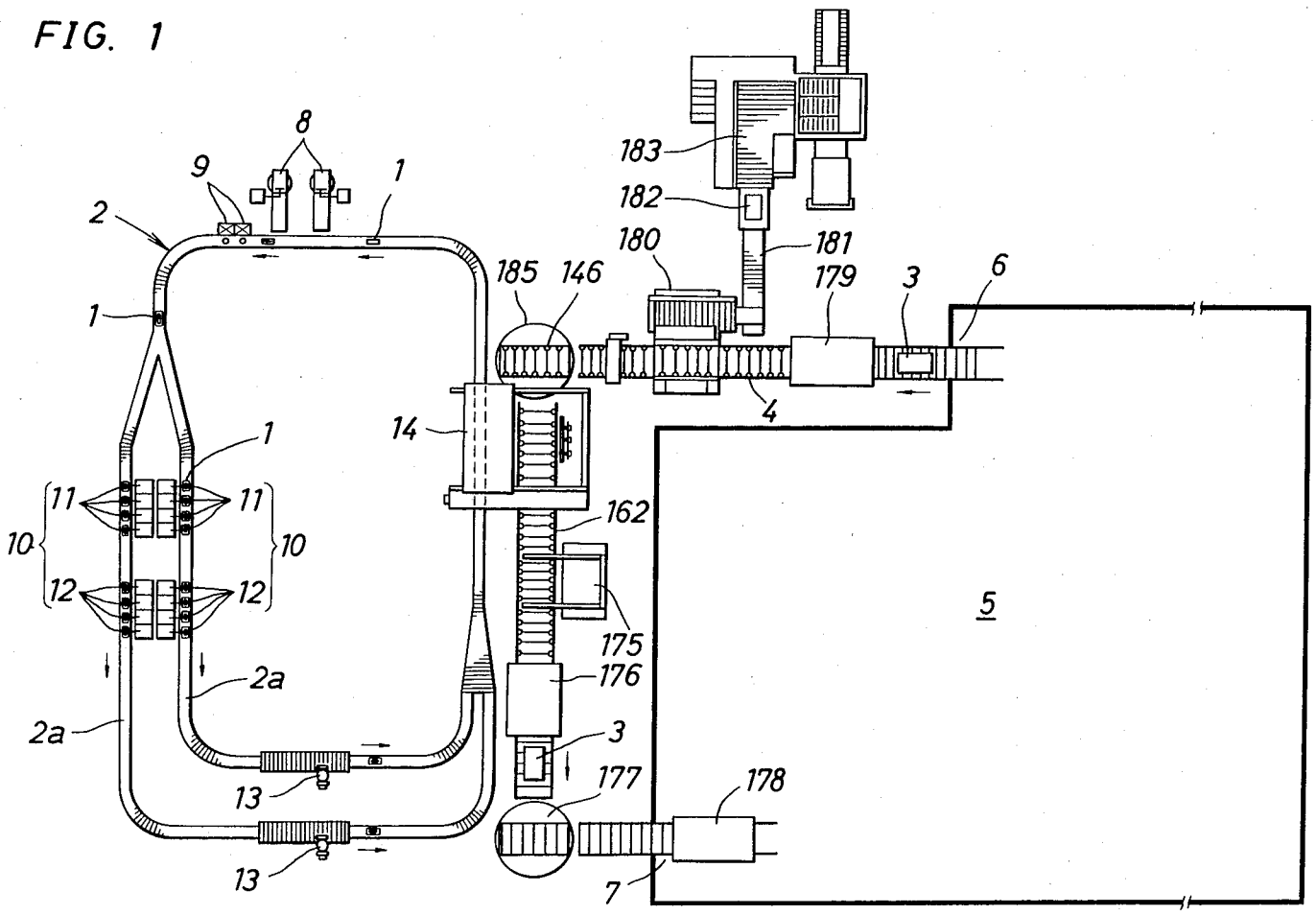
FIG. 1 is a schematic plan view of an entire configuration of an asphalt latex filling, packing and storing system including an automatic bagging system according to the present invention.

Referring first to FIG. 1 which is a schematic plan view showing an entire arrangement of an asphalt latex filling, packing and storing system including an automatic bagging system according to the present invention, the system includes two principal conveyor lines including a carrying can conveyor line 2 for conveying carrying cans 1 made of a metal material and a pallet conveyor line 4 for conveying pallets 3. The former conveyor line 2 extends as a whole in an annular form and circulates along the annular path to transport carrying cans 1 while the latter conveyor line 4 extends between an exit 6 and an entrance 7 of a cooling warehouse 5. The carrying can conveyor line 2 is branched midway into two branch conveyor lines 2*a* which are later joined to each other.

Located around the carrying can conveyor line 2 are, as listed along a transporting direction of the conveyor line 2, two automatic bag supply apparatuses 8, two inflators (bag inflating apparatus) 9, and for each of the branch conveyor lines 2*a*, four fixed volume filling machines 11 and four weight filling machines 12 of an automatic filling apparatus 10 and a sewing machine 13 downstream of the weight filling machine 12, and a dumping apparatus 14 downstream of a joining point of the branch conveyor lines 2*a*.

As empty carrying cans 1 are fed to the automatic bag supply apparatus 8, paper bags are fed one by one into empty carrying cans 1 by the apparatus 8. The carrying cans 1 are then fed to the inflators 9 by which the paper bags therein are inflated, and then the carrying cans 1 are fed onto and separately transported by the two branch conveyor lines 2*a* on which the paper bags therein are filled with a fixed volume of asphalt latex smaller than a prescribed fill-up amount (prescribed weight) by the fixed volume filling machines 11 and then filled further with asphalt latex by the weight filling machines 12 until the prescribed weight is reached. After that, mouths of the paper bags are sealed on the branch conveyor lines 2*a* by the sewing machines 13, and the carrying cans 1 are fed into the joined carrying can conveyor line 2 by which they are fed to the dumping apparatus 14. The dumping apparatus 14 recevies a predetermined plurality (for example, 4) of the carrying cans 1 and transfers the thus filled up sealed paper bags in the carrying cans 1 onto a pallet 3. The carrying cans 1 emptied in this manner are then fed again to the automatic bag supply apparatus 8 in order to repeat the same series of operations.

Now, concrete structures of the automatic bag supply apparatus 8, the inflators 9, the fixed volume filling machines 11, the weight filling machines 12 and the dumping apparatus 14 will be described one after another in detail.

Figure 2:
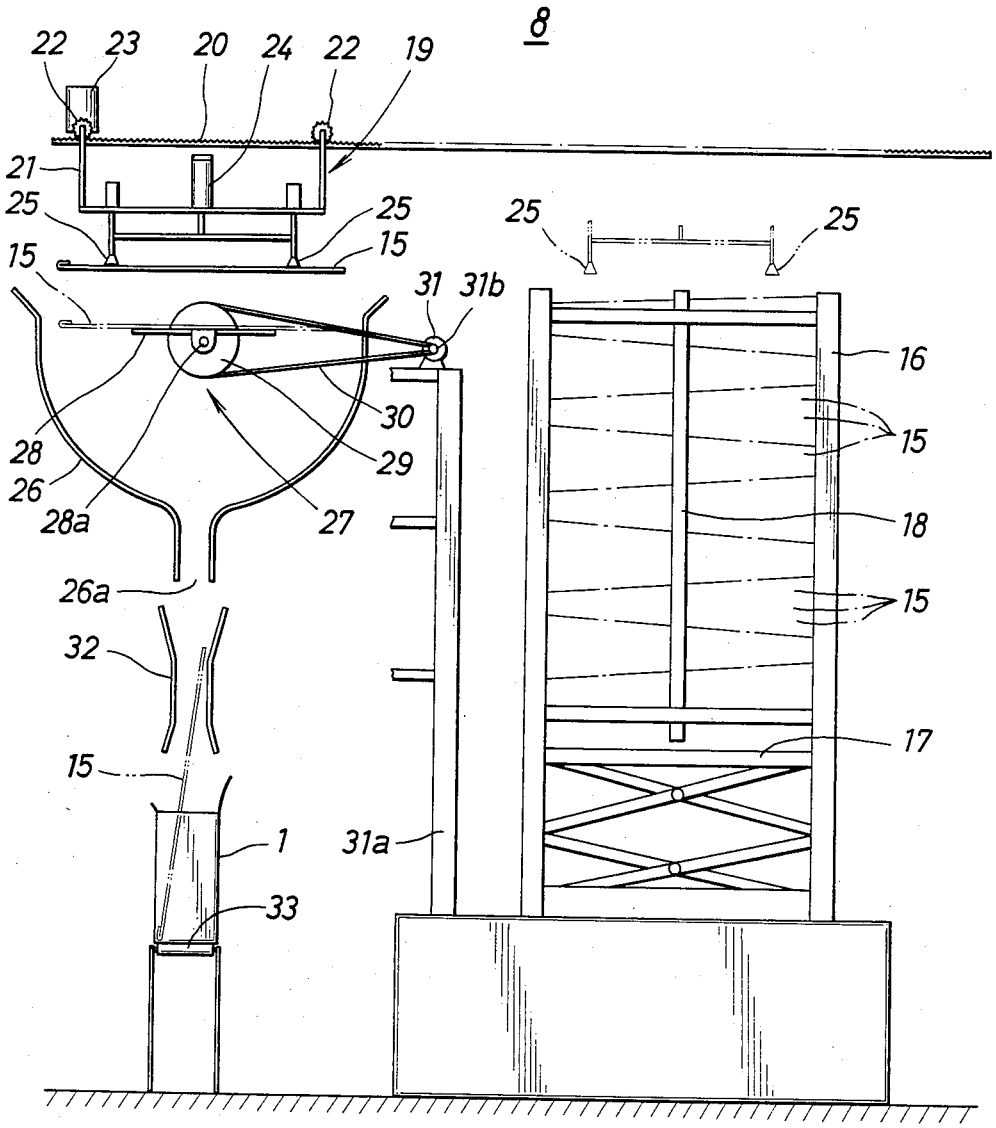
FIG. 2 is a simplified side elevational view of a first embodiment of a bag supply apparatus according to the invention.

Referring to FIG. 2, there is shown a first embodiment of the automatic bag supply apparatus 8. A large number of known paper bags 15 having their opposite sides folded inside flatly over themselves are accumulated with open or mouth sides and closed bottom sides thereof directed alternately in opposite directions for each predetermined plural number (for example, 25) of such paper bags 15 (each chain line indicates a heap of the predetermined plural number of such paper bags 15)

on a table lifter 17 which is mounted for up and down movement within a magazine 16. In particular, since the closed bottom side of a paper bag 15 has a greater thickness than the open side, the paper bags 15 are heaped up with the open and closed sides thereof directed alternately in opposite directions so that they may lie substantially in horizontal planes. Thus, the paper bags 15 are moved up along a guide frame 18 of the magazine 16 as the table lifter 17 moves up. Then, the paper bags 15 are attracted and separated one by one from the top of the heap of the paper bags 15 by an attracting and transporting machine 19. The table lifter 17 is moved up in a stepwise manner by a predetermined amount (corresponding to the thickness of a single or a plurality of paper bags) by a known driving means not shown so that the top or uppermost one of the paper bags 15 may be held substantially at a fixed height.

The attracting and transporting machine 19 includes a travelling frame 21 depending from a horizontally extending rack 20 and having a pair of pinions 22 meshed with the rack 20 so that the travelling frame 21 may move horizontally along the rack 20 by rotating one of the pinions 22 by a motor 23. The attracting and transporting machine 19 further includes a plurality of attracting pads 25 mounted on the travelling frame 21 and connected to be moved up and down by a vertical motion cylinder 24 carried on the travelling frame 21. On the attracting and transporting machine 19, the attracting pads 25 are moved down above the magazine 16 to attract an uppermost paper bag 15 thereto by vacuum whereafter they are moved up to separate the uppermost paper bag 15 from the remaining paper bags 15 in the magazine 16, and then the travelling frame 21 is moved horizontally to a position above a hopper 26 and releases the paper bag 15 there from attraction by the attracting pads 25. Such a transporting operation of a paper bag 15 is counted, by a counter not shown.

Upon release from the attracting pads 25, the paper bag drops into a hopper 26 serving as a feed guide means and is thus received on a turnover plate 28 of an orientation mechanism 27 located in the hopper 26. The turnover plate 28 is supported for integral rotation on a shaft 28*a* within the hopper 26 and is connected to a bidirectional turnover motor 31 mounted on a suitable machine frame 31*a* via a pulley (or else a gear wheel) 29 secured to the shaft 28*a* and a belt (or else a chain) 30 extending between the pulley 29 and a motor shaft 31*b* so that the turnover plate 28 may be rotated selectively in a clockwise or counterclockwise direction from a horizontal position as shown in FIG. 2 by the motor 31. Whether the turnover plate 28 is rotated in the clockwise direction or in the counterclockwise direction, that is, whether the motor 31 is rotated forwardly or reversely, is automatically controlled depending upon the count value of the counter, and each time the direction or orientation of the paper bags within the magazine 16 reverses, that is, each time a paper bag 15 picked up from the top of the heap of the paper bags 15 within the magazine 16 is directed in the opposite direction to that of the last picked up paper bag (which occurs, for example, for each 25 bags), the direction of rotation of the turnover plate 28 is reversed.

Figure 3:
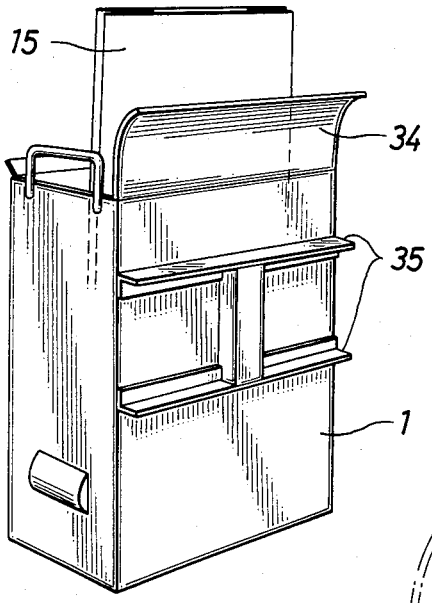

Thus, when a paper bag 15 is placed on the turnover plate 28 with the bottom side thereof directed leftwardly in FIG. 2, the turnover plate 28 will be rotated in the counterclockwise direction from the horizontal position, but on the contrary when a paper bag 15 is placed on the turnover plate 28 with the bottom side thereof directed rightwardly, the turnover plate 28 will be rotated in the clockwise direction. Therefore, if the turnover plate 28 is rotated from the horizontal position, whether a paper bag 15 on the turnover plate 28 has its bottom side directed leftwardly or rightwardly, the paper bag 15 will slip and drop from the turnover plate 28 surely with the bottom side thereof directed downwardly. Thus, the paper bag 15 will then be guided by the hopper 26 and drop substantially vertically from an exit 26*a* at a lower end of the hopper 26 into a carrying can 1 on a conveyor 33 of the carrying can conveyor line 2, passing through a guide conduit 32. The paper bag 15 received in the carrying can 1 will bear against and be erected uprightly within the carrying can 1 with its open or mouth side directed upwardly and with an upper portion thereof projected upwardly from the carrying can 1 as seen in FIG. 3. The carrying can 1 has a slipping guide plate 34 projected upwardly from a side of its top opening and has a pair of engaging plates 35 mounted on and extending horizontally from each of opposite side walls thereof (also refer to FIG. 9).

Figure 4:
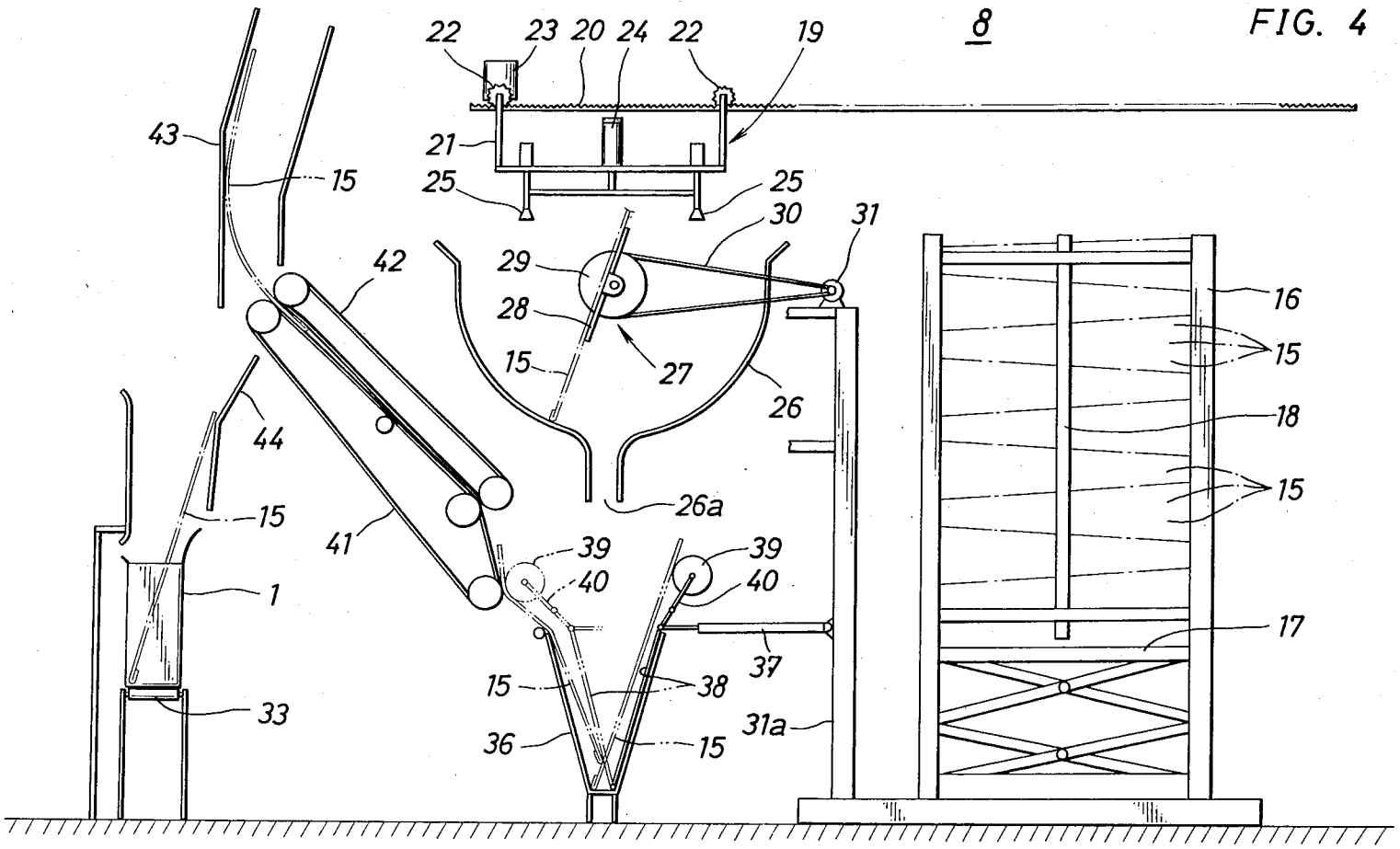
FIG. 4 is a simplified side elevational view of a second embodiment of a bag supply apparatus according to the invention.

A second embodiment of the automatic bag supply apparatus 8 is shown in FIG. 4. The second embodiment is different from the first embodiment in that a paper bag 15 dropped from the hopper 26 is not received directly into a carrying can 1 as in the first embodiment but is first arrested and transported upwardly and then fed into a carrying can 1.

In particular, an intermediate vessel 36 is located below the hopper 26 so that a paper bag 15 which is dropped from the hopper 26 with its bottom side directed downwardly may be once received into the intermediate vessel 36. A tiltable plate 38 is mounted for pivotal motion within the intermediate vessel 36 and is tilted by a tilting cylinder 37. An arm 40 is mounted for pivotal motion at an upper end of the tiltable plate 38 and has a pressure roller 39 supported for rotation at the top thereof. Thus, if a paper bag 15 is dropped into the intermediate vessel 36, then the tilting cylinder 37 operates to turn the tiltable plate 38 from one to the other side within the intermediate vessel 36 to tilt the paper bag 15 to the other side. At the same time, the arm 40 is also pivoted in the same direction so that the pressure roller 39 presses the paper bag 15 against a lower belt conveyor (or a spring conveyor) 41 extending obliquely above the other side of the intermediate vessel 36. An upper belt conveyor (or a spring conveyor) 42 is contacted under pressure with the lower belt conveyor 41 so that the paper bag 15 may be clamped between and transported obliquely upwardly by the upper and lower conveyors 42 and 41. The paper bag 15 is then released from the belt conveyors 41 and 42 when it has been introduced into a guide conduit 43 located above the belt conveyors 41 and 42. The paper bag 15 thus released will then drop along a guide plate 44 into a carrying can 1 on a conveyor 33. While the second embodiment is complicated in structure comparing with the first embodiment, the overall height of the entire arrangement can be reduced.

Figure 6:
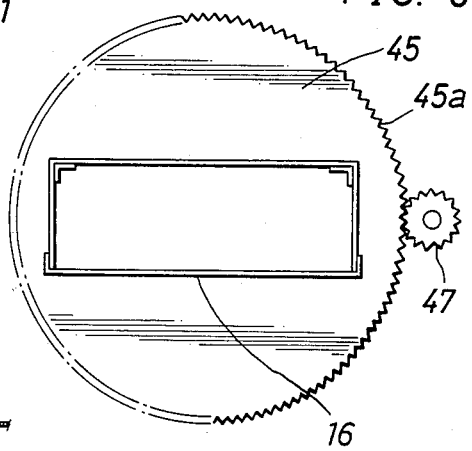
FIG. 6 is a plan view, in an enlarged scale, of a magazine and a turntable of the bag supply apparatus of FIG. 5.

FIGS. 5 to 8 shows a third embodiment of the automatic bag supply apparatus 8. In the third embodiment, a magazine 16 and a table lifter 17 are located on a turntable 45 which constitutes an orienting means. The turntable 45 has serrations 45*a* formed around a circumferential periphery thereof as seen in FIG. 6. The serrated periphery 45*a* of the turntable 45 is meshed with a gear wheel 47 connected to be rotated by a table rotating motor 46. The turntable 45 is thus rotated by an angle of 180 degrees by the motor 46 each time a predetermined plural number of paper bags 15 within the magazine 16 are transported therefrom by an attracting and transporting machine 19 in order to orient the paper bags 15 within the magazine 16 such that they may be transported therefrom by the attracting and transporting machine 19 certainly with the bottom sides thereof directed forwardly.

Figure 7:
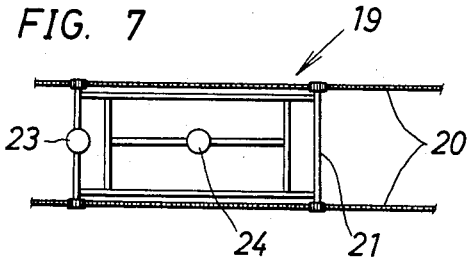
FIG. 7 is a plan view of an attracting and transporting machine of the apparatus of FIG. 5.
Figure 8:
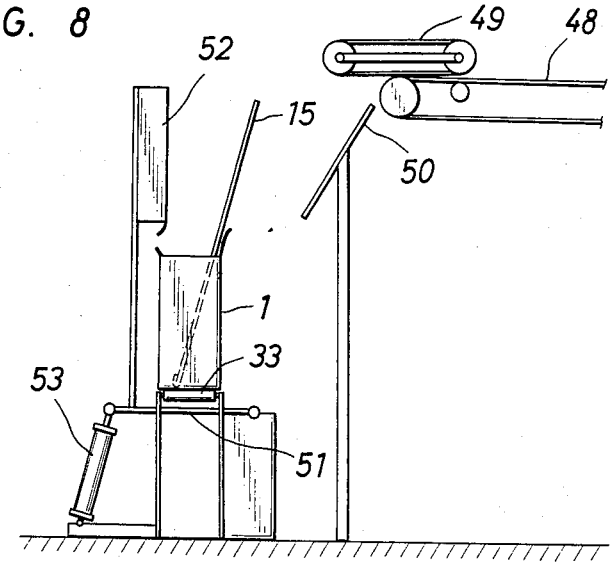
FIG. 8 is a simplified side elevational view of a carrying can tilting mechanism of the apparatus of FIG. 5.

Each of paper bags 15 transported one by one from the magazine 16 by the attracting and transporting machine 19 (FIG. 7 is a plan view of the machine 19) is released from attraction of the machine 19 above and received on a belt conveyor (or a spring conveyor) 48 and is then put between the belt conveyor 48 and a pressure belt conveyor (or a spring conveyor) 49 which is contacted under pressure of a spring force with a forward end portion of the belt conveyor 48. Consequently, the paper bag 15 is then transported while being held between the belt conveyors 48 and 49.

Figure 5:
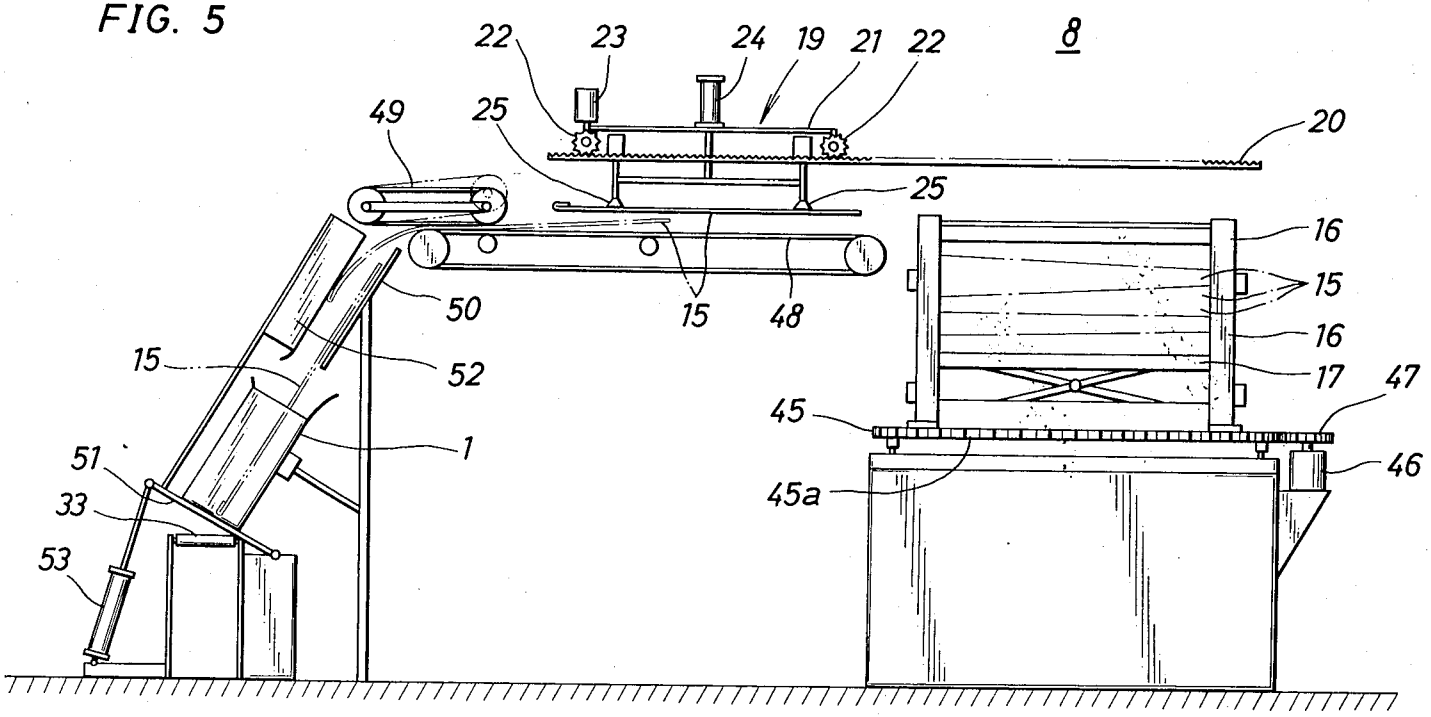
FIG. 5 is a simplified side elevational view of a third embodiment of an entire bag supply apparatus according to the invention.

A tiltable guide plate 50 is securely mounted below the belt conveyors 48 and 49, and a tiltable bed plate 51 is supported for pivotal tilting motion at a position a little below a plane of a conveyor 33 for transporting a carrying can 1. A movable guide plate 52 is erected uprightly and securely mounted on the tiltable bed plate 51. The tiltable bed plate 51 is normally held horizontally at a predetermined position below the plane of the conveyor 33 and can be tilted upwardly above the conveyor 33 by a tilting cylinder 53 to receive a carrying can 1 from the conveyor 33 and lift it obliquely as seen in FIG. 5. In this instance, the movable guide plate 52 extends substantially in a parallel opposing relationship to the inclined guide plate 50 to introduce a paper bag 15 fed in by the belt conveyors 48 and 49 in the manner described above into the carrying can 1 on the tiltable bed plate 51. After the paper bag 18 has been thrown into the carrying can 1 in this manner, the cylinder 53 now operates back to return the tiltable bed plate 51 to its initial position below the conveyor 33 to place the carrying can 1 again onto the conveyor 33.

Figure 9:
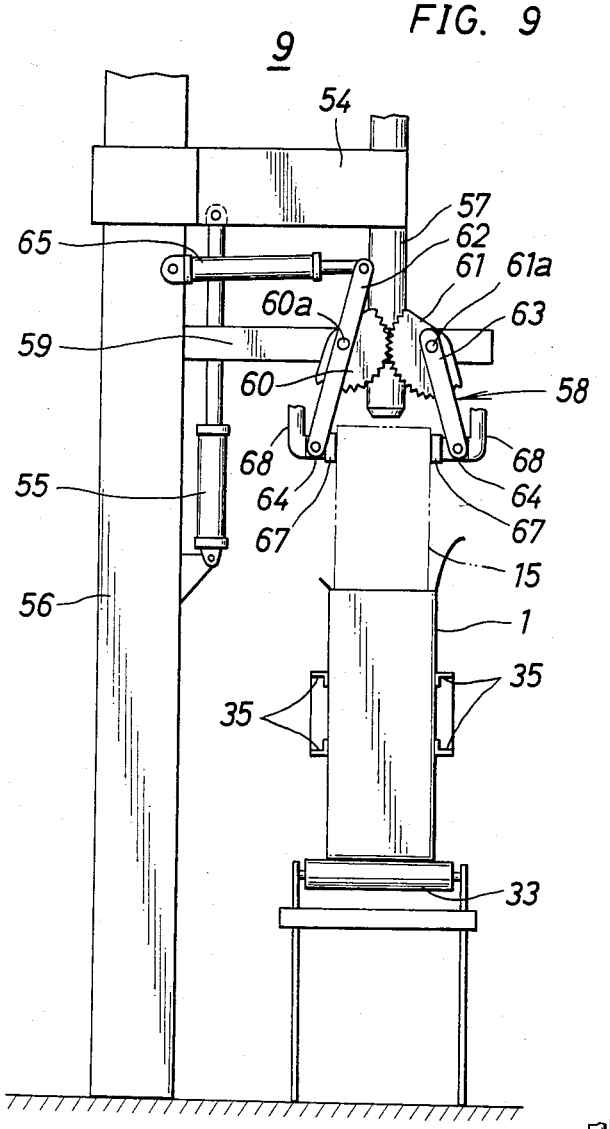
FIG. 9 is a side elevational view of an inflator for inflating a paper bag.
Figure 10:
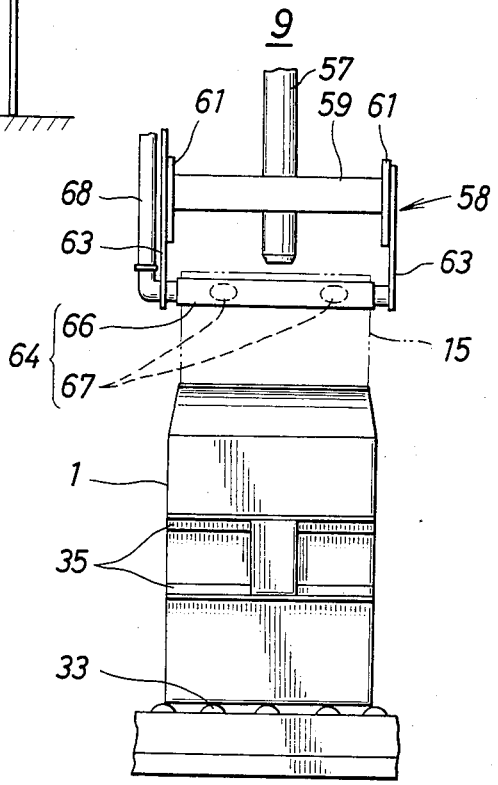
FIG. 10 is a plan view of part of the inflator of FIG. 9.

The paper bag 15 fed into the carrying can 1 as seen in FIG. 3 is then fed into the inflator 9 shown in FIGS. 9 and 10 by the conveyor 33.

Referring to FIGS. 9 and 10, the inflator 9 includes a sliding member 54 mounted for sliding up and down movement on and along a vertical rail 56 and connected to be moved up and down by operation of a vertically moving air cylinder 55. An air nozzle 57 is mounted vertically at an end of the sliding member 54, and a bag opening mechanism 58 is mounted on the vertical rail 56. The bag opening mechanism 58 includes an arm 59 fixedly mounted on and extending horizontally from the vertical rail 56, a driving sector gear 60 supported for integral rotation with a shaft 60*a* on the arm 59, and a driven sector gear 61 supported for integral rotation with another shaft 61*a* on the arm 59 and held in meshed engagement with the sector gear 60. A driving link 62 and a driven link 63 are securely mounted on the shafts 60*a* and 61*a*, respectively, and each have a vacuum attracting member 64 mounted at a lower end thereof while the driving link 62 has the opposite upper end thereof connected to an opening and closing air cylinder 65. Each of the vacuum attracting members 64 includes a vacuum pipe 66 and a pair of attracting pads 67 securely mounted on the vacuum pipe 66 and is connected either to a blower or to a vacuum pump (neither is shown) via an air hose 68 in order that vacuum may act therein.

The vacuum attracting members 64 are normally open to each other, that is, spaced from each other, so that as a paper bag 15 is fed to a spacing between them (just below the air nozzle 57) by a conveyor 33, the opening and closing air cylinder 59 operates to first close the vacuum attracting members 64, that is, move to each other until the attracting pads 67 thereof attract opposite sides of the paper bag 15 thereto by vacuum and then open them again, that is, move away from each other together with the opposite sides of the paper bag 15 thereby to open the mouth of the paper bag 15. After that, the air cylinder 55 operates to lower the air nozzle 57 until its nozzle opening is put into the thus opened mouth of the paper bag 15. In this condition, air is blown into the paper bag 15 from the air nozzle 57 to forcibly inflate the paper bag 15.

The paper bag 15 thus inflated is then fed, while received in a carrying can 1, into a fixed volume filling machine 11 as shown in FIGS. 11 to 16 of the automatic filling apparatus 10 by the conveyor 33.

Referring now to FIGS. 11 to 16, each of the branch conveyor lines 2*a* includes a plurality of (four in FIG. 12) fixed volume filling machines 11 disposed in a row along a direction of transportation thereof. A lifter 70 is provided for each two of such fixed volume filling machines 11. The lifter 70 is operable to receive a carrying can 1 from the conveyor 33 and move it up and down, and includes conveyor rollers 71 and a stopper 72 for positioning a carrying can 1. The lifter 70 is moved up and down as a whole by a lifter air cylinder 73 while keeping a horizontal condition.

Figure 11:
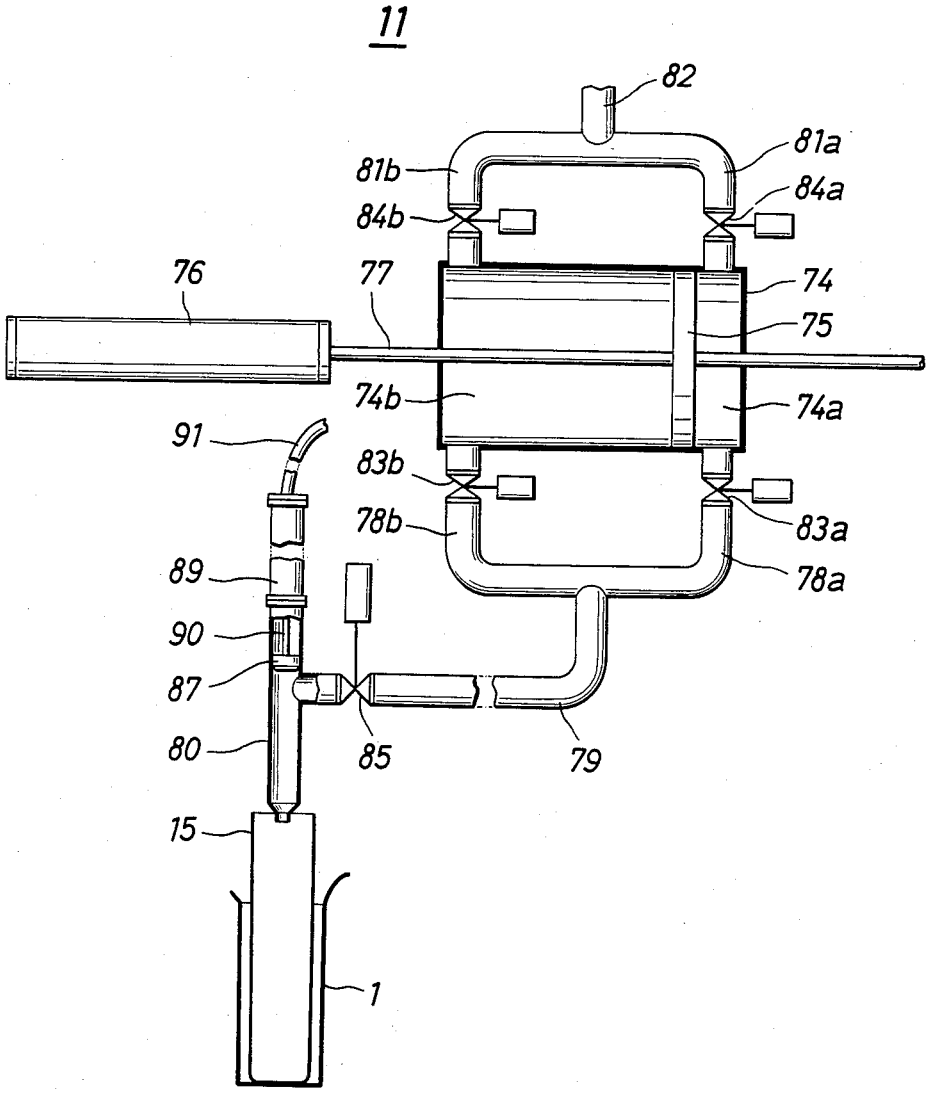
FIG. 11 is a schematic illustration of a fixed volume filling machine.

Each of the fixed volume filling machines 11 includes, as seen from FIG. 11 which illustrates, in a rather exaggerated diagrammatic representation, structure of the machines 11, a fixed volume member 74 in the form of a large diameter cylinder, and a piston 75 fitted for sliding movement within the fixed volume member 74. The piston 75 is connected to a piston rod 77 of an asphalt latex extruding hydraulic cylinder 76 acting as an extruder. The interior of the fixed volume member 74 is partitioned by the piston 75 into a front chamber 74*a* and a rear chamber 74*b* which are connected to a volume injector 80 in the form of a vertical cylinder by way of a pair of discharging side branch pipe conduits 78*a* and 78*b* and a common pipe conduit 79. The front and rear chambers 74*a* and 74*b* of the fixed volume member 74 are also connected to an asphalt latex supply source (not shown) by way of a pair of supplying side branch pipe conduits 81*a* and 81*b* and a common pipe conduit 82. Magnet valves 83*a*, 83*b* and 84*a*, 84*b* are provided for the discharging side branch pipe conduits 78*a*, 78*b* and the supplying side branch pipe conduits 81*a*, 81*b* respectively. Thus, if the hydraulic cylinder 76 operates to advance the piston 75, asphalt latex within the front chamber 74*a* is extruded therefrom while at the same time asphalt latex is supplied into the rear chamber 74*b*. On the contrary, if the piston 75 is retracted, asphalt latex within the rear chamber 74*b* is extruded therefrom while at the same time asphalt latex is supplied into the front chamber 74*a*. In these instances, the magnet valves 83*a*, 83*b*, 84*a* and 84*b* are selectively opened and closed to allow such supplying and discharging of asphalt latex into and from the fixed volume member 74. Asphalt latex thus extruded from the front chamber 74*a* or the rear chamber 74*b* is fed into the volume injector 80 when a further magnet valve 85 provided for the common pipe conduit 79 is open.

Figure 13:
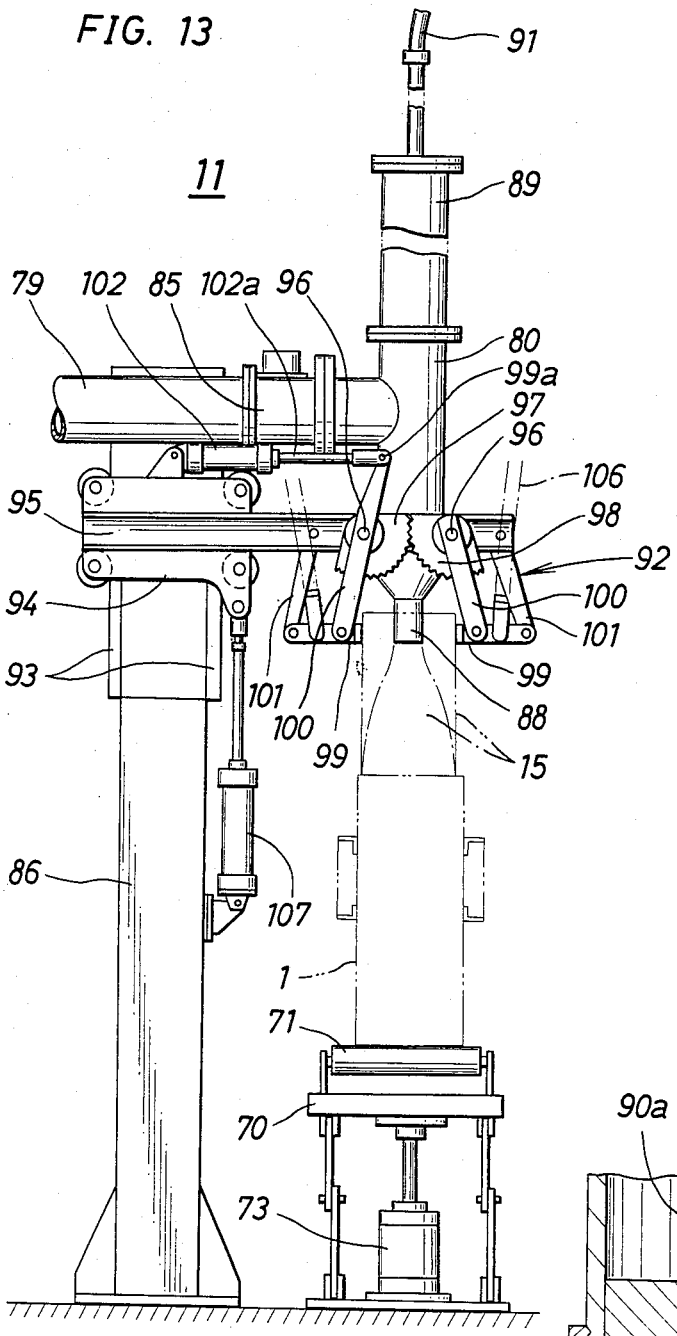
FIG. 13 is a side elevational view of the machine of FIG. 11.
Figure 14:
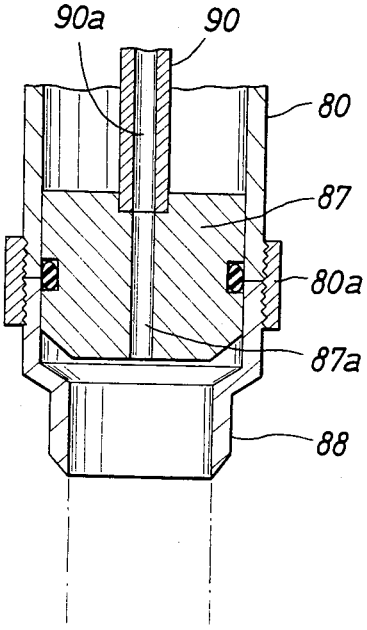
FIG. 14 is an enlarged vertical sectional view of a volume pouring device of the machine of FIG. 11.

The volume injector 80 is mounted on a support rod 86 and extends in a vertical direction as seen in FIG. 13. A piston 87 is fitted for up and down sliding movement within the volume injector 80 as seen in FIG. 14, and a nozzle 88 is removably connected to a lower end of the volume injector 80 by means of a nut 80a. The piston 87 is securely mounted at a lower end of a piston rod 90 of an asphalt latex discharging air cylinder 89 so that it may be slidably moved up and down by operation of the air cylinder 89. Air paths 87a and 90a are formed in a contiguous relationship in the piston 87 and the piston rod 90, respectively, and are connected to an external air hose 91 so that they may be supplied with air and blow the same from the center of a bottom face of the piston 87. The piston 87 is normally positioned a little above a connection port 79a of the common pipe conduit 79 to the volume injector 80 to allow communication of asphalt latex from the common pipe conduit 79 into the volume injector 80.

Figure 12:
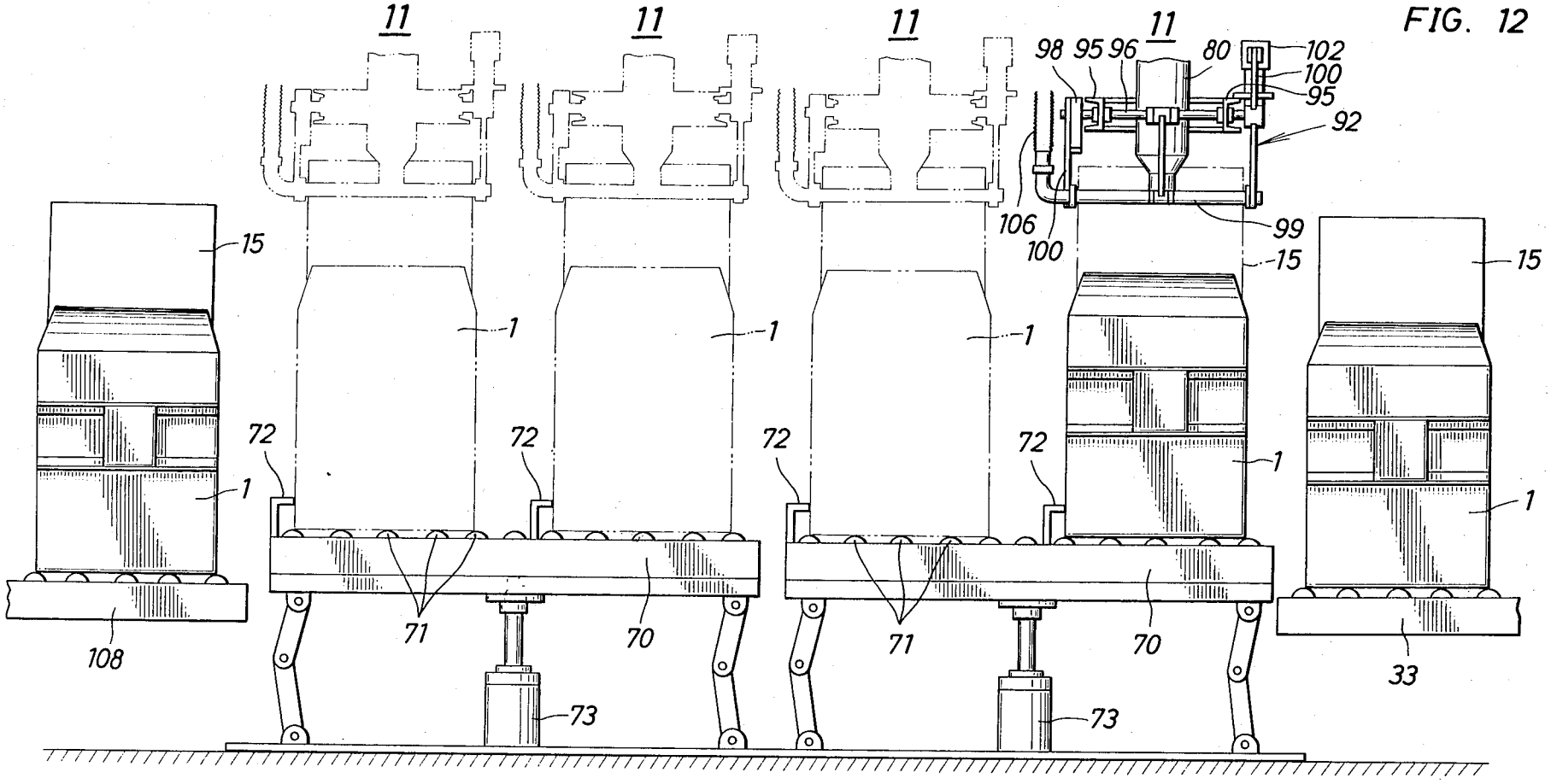
FIG. 12 is a front elevational view of the machine of FIG. 11.

A bag opening and closing mechanism 92 is also mounted on the support rod 86 as seen in FIGS. 12 and 13. The bag opening and closing mechanism 92 includes a sliding bed 94 mounted for up and down sliding movement on and along a pair of rails 93 mounted at an upper part of the support rod 86. A pair of arms 95 are mounted on and extend horizontally from left and right opposite sides of the sliding bed 94, and a pair of front and rear shafts 96 are mounted for rotation on and extend horizontally between the arms 95. A driving sector gear 97 is securely mounted on the rear one of the shafts 96, and a driven sector gear 98 is securely mounted on the other front shaft 96 and held in meshed engagement with the driving sector gear 97. A pair of front and rear vacuum attracting members 99 are connected to lower ends of a pair of links 110 securely mounted on the shafts 96 and also connected to lower ends of another pair of links 101 pivotally mounted at the other upper ends thereof to the arm 95 so that they may move horizontally back and forth relative to the arms 95. That one of the links 101 which is securely mounted on the rear one of the shafts 96 is connected at an upper end thereof by means of a pin 99a to a piston rod 102a of a bag opening and closing air cylinder 102 which is pivotally mounted on the arm 95.

Figure 15:
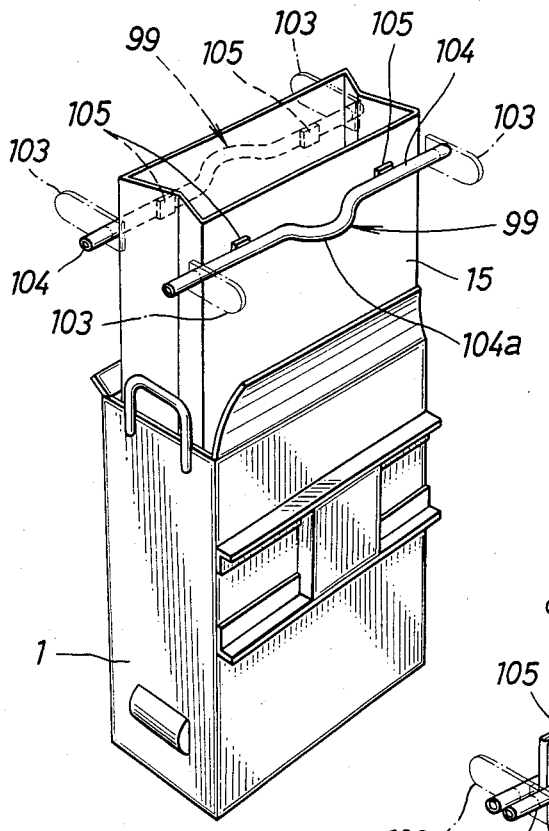
FIG. 15 is a perspective view of a bag opening and closing mechanism of the machine of FIG. 11.
Figure 16:
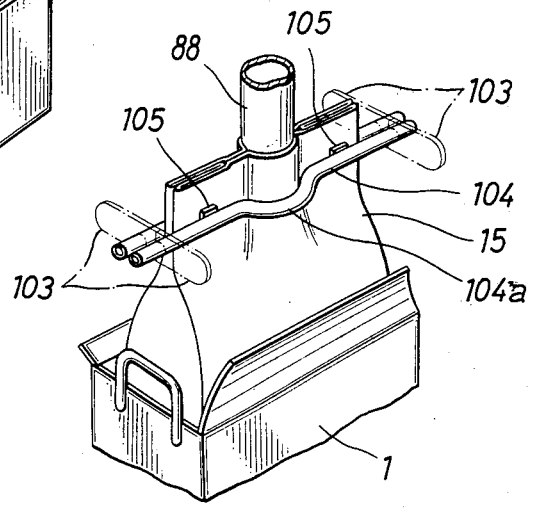
FIG. 16 is a partial perspective view of the mechanism of FIG. 15.

Each of the vacuum attracting members 99 includes, as shown in FIGS. 15 and 16, two pairs of left and right brackets 103, a pair of vacuum pipes 104 extending horizontally between the brackets 103, and a pair of attracting pads 105 securely mounted at left and right portions of each of the vacuum pipes 104. The vacuum pipes 104 are connected to a blower or a vacuum pump not shown each by way of an air hose 106 in order to produce vacuum in the vacuum pipes 104. The front and rear vacuum attracting members 99 are outwardly curved each substantially in a semicircular shape at a central portion 104a of the vacuum pipe 104 thereof and are moved toward or away from each other by operation of the bag opening and closing air cylinder 102. The sliding bed 94 is moved up or down by operation of a bag lifting and lowering air cylinder 107 mounted for pivotal motion on the support rod 86.

Since the bag opening and closing mechanism 92 is at its lower position and the vacuum attracting members 99 are spaced away from each other before a carrying can 1 is transferred onto the lifter 70, a paper bag 15 transported thereto is positioned between the vacuum attracting members 99. If transfer of a carrying can 1 onto the lifter 70 is detected, the bag opening and closing air cylinder 102 automatically makes a full reciprocal motion to move the vacuum attracting members 99 towards and then away from each other. Consequently, the paper bag 15 is attracted by the front and rear attracting pads 105 and is opened at the mouth thereof as seen in FIG. 15 as the front and rear vacuum attracting members 99 are moved away from each other. After then, the bag lifting and lowering air cylinder 107 and the lifter lifting and lowering air cylinder 73 operate simultaneously so that the paper bag 15 is lifted to a predetermined height together with the carrying can 1 with the mouth thereof kept open by attraction thereof by the vacuum attracting members 99 until the nozzle 88 of the volume injector 80 is inserted into the center of the mouth of the open paper bag 15.

After completion of the forward movement of the air cylinders 107 and 73, the bag opening and closing air cylinder 102 is automatically moved forwardly to move the vacuum attracting members 99 toward each other to close the mouth of the paper bag 15. In this instance, since the nozzle 88 of the volume injector 80 extends into the paper bag 15 and the central portions 104a of the vacuum pipes 104 are curved outwardly from each other, the mouth of the paper bag 15 is closed to cover the nozzle 88 from the front and rear sides thereof with the central portions 104a of the vacuum pipes 104 as seen in FIG. 16. This condition is maintained as the bag opening and closing air cylinder 102 is stopped. While this condition is maintained, asphalt latex within the front chamber 74a or the rear chamber 74b of the fixed volume member 74 is extruded by operation of the hydraulic cylinder 76 and is thus poured into the paper bag 15 through the volume injector 80. After completion of extrusion of asphalt latex from the front chamber 74a or the rear chamber 74b, the air cylinder 89 operates to move down the piston 87 to extrude asphalt latex remaining in the volume injector 80 into the paper bag 15. Since air is blown from the air path 87a when the piston 87 reaches its lower limit position, asphalt latex remaining adhered to the bottom face of the piston 87 and the mouth of the nozzle 88 is also blown off into the paper bag 15. The volume or capacity of the fixed volume member 74 is selected to be an amount corresponding to about 90 percent or so of a rated weight to be filled in the paper bag 15, and thus the paper bag 15 is filled in a short period of time by the fixed volume filling machine 11 with asphalt latex to about nine tenths of the rated fill-up amount (rated weight) without effecting any weight measurement. Such filling of a fixed volume is performed at a same time for a number of paper bags 15 corresponding to the number of the fixed volume filling machines 11. After completion of the filling operation, the bag opening and closing air cylinder 102 moves backwardly to open or move the vacuum attracting members 99 away from each other and at the same time the vacuum attracting action of the vacuum attracting members 99 is stopped to release the attraction by the attracting pads 105. Then, the lifter 70 is lowered to move down the paper bag 15 together with the carrying can 1, and the bag lifting and lowering air cylinder 107 is retracted to lower the vacuum attracting members 99 back to its home position while the vacuum attracting members 99 are held spaced from each other.

Figure 17:
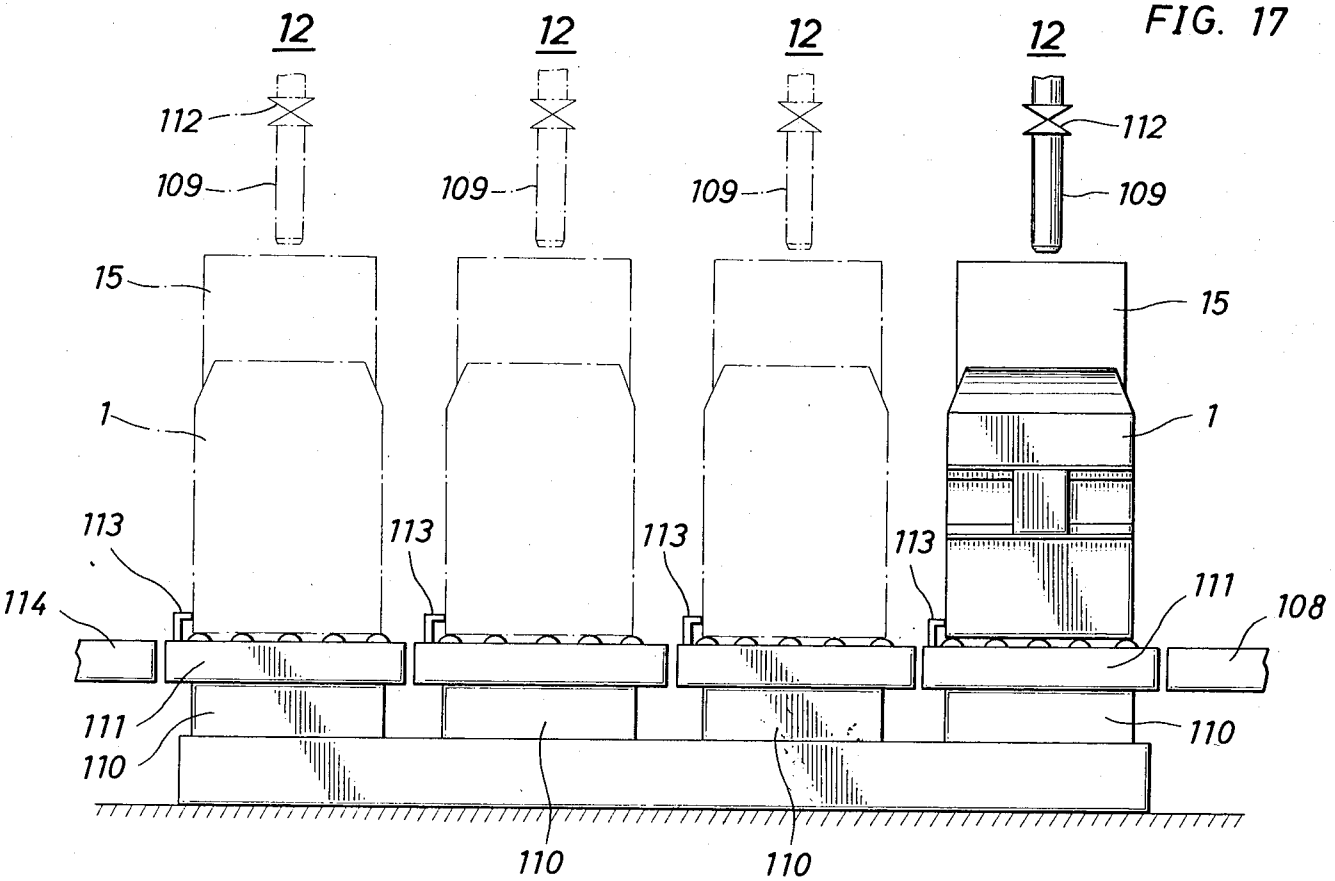
FIG. 17 is a front elevational view of a weight filling machine.

The paper back 15 which has been filled with the fixed volume of asphalt latex in this manner is now delivered from the lifter 70 to a weight filling machine 12 shown in FIG. 17 by another conveyor 108 while it is held accommodated in the carrying can 1 as seen in FIG. 12. Also a plurality of (four in FIG. 17) such weight filling machines 12 are disposed in a row in a direction of transportation along each of the branch conveyor lines 2a. Each of the weight filling machines 12 includes a weight injector 109 mounted vertically on a support rod not shown and connected to an asphalt latex supply source not shown either, a weighing instrument 110 including a known load cell therein, and a conveyor 111 placed on the weighting instrument 110. A magnet valve 112 is provided for the weight injector 109, and a stopper 113 for positioning a carrying can 1 is provided on the conveyor 111.

Figure 18:
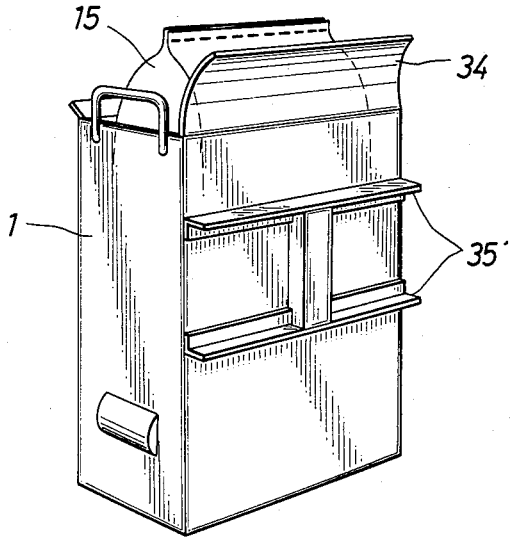
FIG. 18 is a perspective view of a sealed paper bag and a carrying can in which the sealed paper bag is contained.

If a carrying can 1 is transferred onto the conveyor 111 on the weighing instrument 110, the magnet valve 112 is automatically opened to allow asphalt latex from the weight injector 109 to be injected, while being weighed by the weighing instrument 110, into a paper bag 15 which has been filled to about 90 percent or so with asphalt latex as described above and has its mouth opened. When the weight of asphalt latex in the paper bag 15 reaches a rated level, the magnet valve 112 is closed in response to an output signal of the load cell of the weighing instrument 110. Such filling operation with asphalt latex while its weight is being weighed is performed for a plurality of such weight filling machines 12. After completion of such filling up operation, the paper bag 15 is fed into a sewing machine by a further conveyor 114 while accommodated in the carrying can 1 and is sealed at the mouth thereof as seen in FIG. 18 whereafter is is fed to the dumping apparatus 14.

Figure 19:
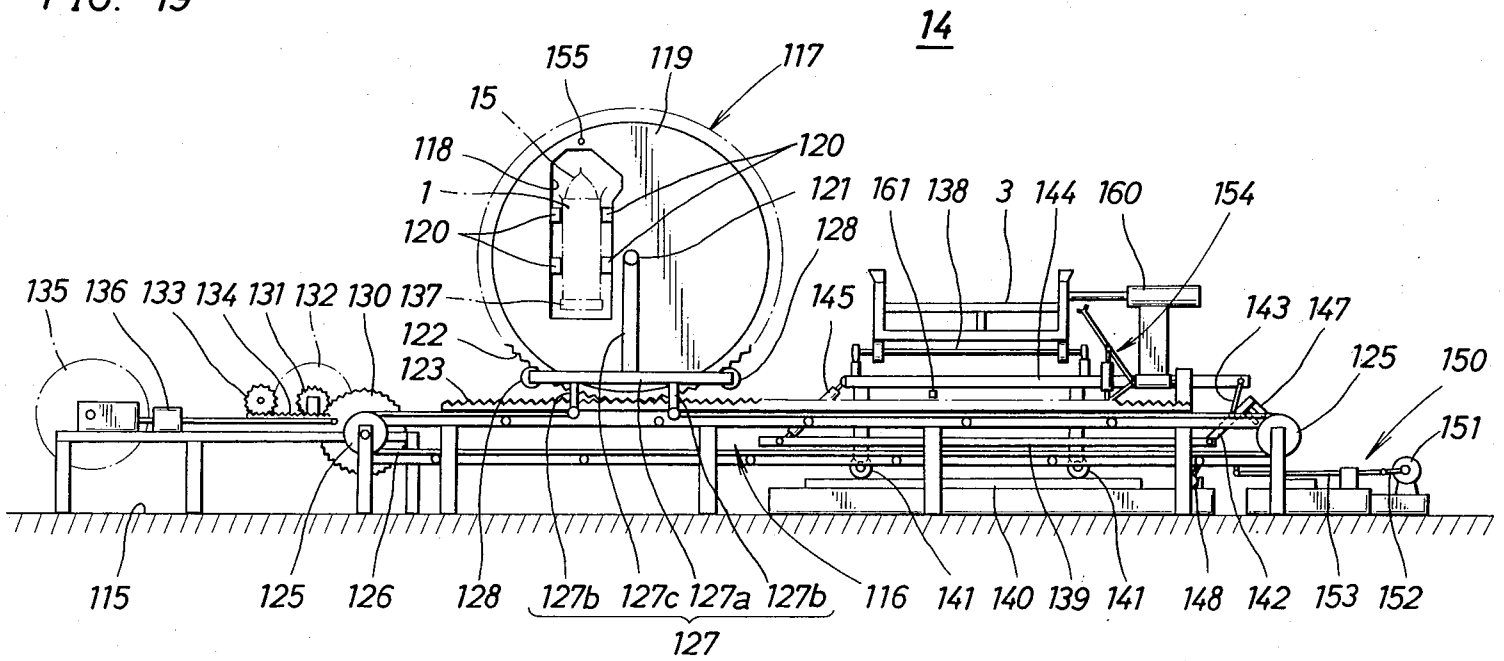
FIG. 19 is a side elevational view of a first embodiment of an entire dumping apparatus according to the invention.
Figure 20:
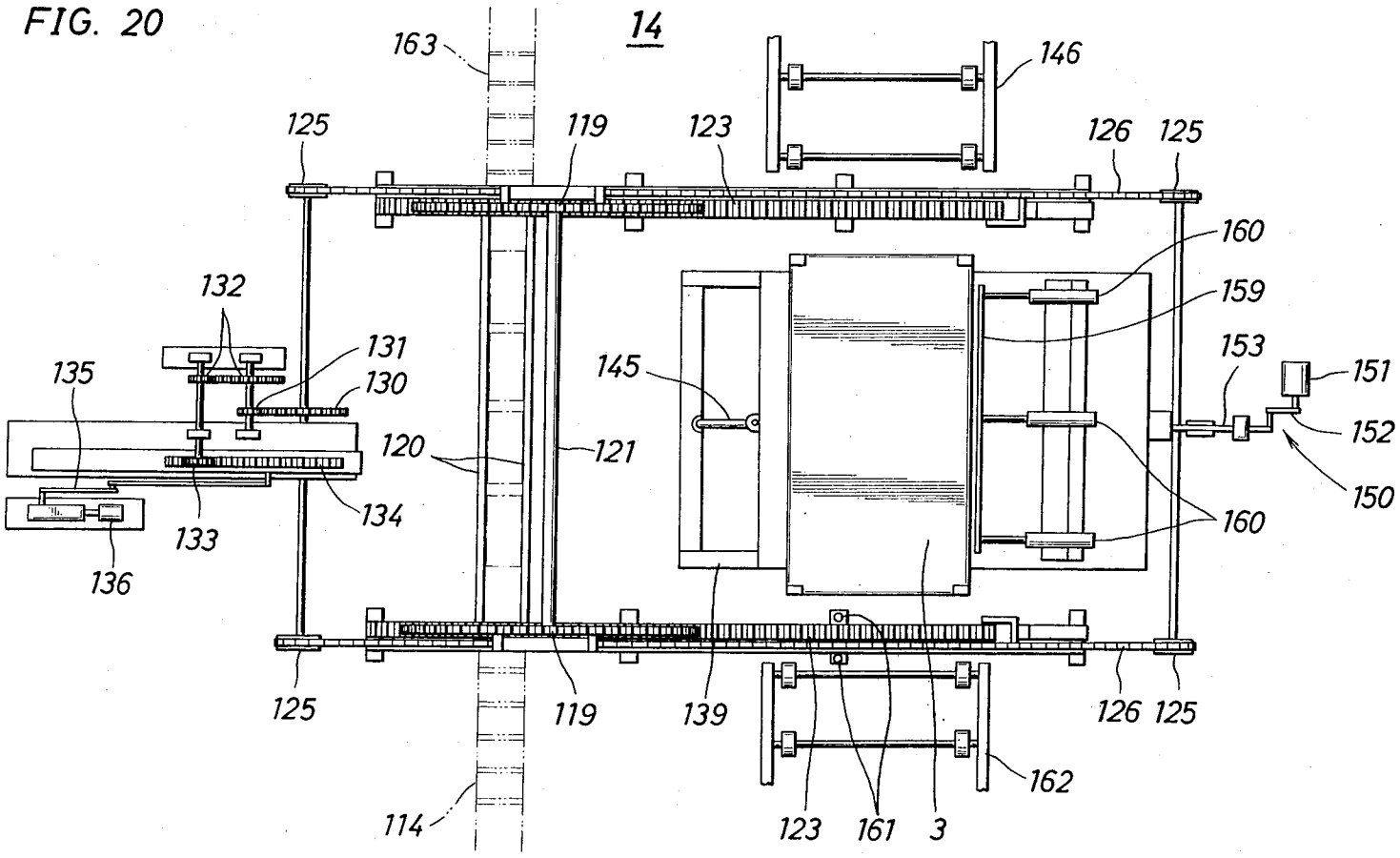
FIG. 20 is a plan view, partly omitted, of the dumping apparatus of FIG. 19.

FIGS. 19 to 24 show a first embodiment of the dumping apparatus 14. Referring first to FIGS. 19 and 20, a tippler 117 is mounted for back and forth rolling movement between and above a pair of left and right frames 116 which extend in parallel relationship on a floor 115. The tippler 117 includes a pair of left and right disks 119 each having a vertically elongated window hole 118 formed therein, and four horizontal rods 120 attached two to each of a pair of opposing vertical edges of the window holes 118 of and interconnecting the left and right disks 119. The left and right disks 119 are also interconnected by a center shaft 121. The left and right disks 119 have serrations 122 formed on outer peripheries thereof and meshed with a pair of left and right racks 123, respectively. The racks 123 are formed on upper faces of a pair of left and right rails 124 made of channel steel and laid on the frames 116 as shown in FIG. 23. Thus, the tippler 117 is roller back and forth on the left and right racks 123 in a manner described just below.

In particular, a chain 126 extends between and around a pair of front and rear sprocket wheels 125 supported for rotation at front and rear ends of each of the left and right frames 116, and the left and right disks 119 are connected to the left and right chains 126 by means of a pair of inverted T-shaped connectors 127, respectively. The connectors 127 each have a horizontal portion 127a and a pair of front and rear legs 127b extending from the horizontal portion 127a and securely mounted on the chains 126, and a pair of rollers 128 rotatably mounted at opposite front and rear ends of the horizontal portion 127a thereof for holding an outer periphery of the disk 119. Further, the connectors 127 support the center shaft 121 of the tippler 117 for rotation at upper ends of vertical portions 127c thereof and each have a roller 129 mounted thereon for rolling movement along a lower face of an upper wall of the rail 124 as shown in FIG. 23. The rear sprocket wheel 125 is connected to a tippler advancing and retracting motor 136 via larger and smaller gear wheels 130 and 131 for speed reduction, a transmission gear wheel 132, a pinion 133, a rack 134 held in meshed engagement with the pinion 133, and a crank 135 for slidably moving the rack 134 back and forth.

Accordingly, as the motor 136 is driven, the chains 126 are circulated a predetermined distance in a forward direction and then back in a reverse direction by the predetermined distance. Consequently, the tippler 117 is rolled first forwardly along the left and right racks 123 (moved rightwardly while being rotated in the clockwise direction in FIG. 19) and then rolled backwardly (moved leftwardly while being rotated in the counterclockwise direction in FIG. 19).

A carrying can 1 which accommodates therein a paper bag 15 filled up with asphalt latex is fed into the dumping apparatus 14 by the conveyor 114 in FIG. 20 while held in a vertical condition and passes through the window hole 118 of one of the disks 119 whereafter it is placed on a can positioning conveyor 137 between the front and rear horizontal rods 120 of the tippler 117.

When it is detected that a predetermined plurality of carrying cans 1 have been placed on the can positioning conveyor 137, the tippler advancing and retracting motor 136 is automatically activated so that the tippler 117 is rolled forwardly in a manner as described above. As a result, the predetermined plurality of carrying cans 1 is lifted by the horizontal rods 120 and moved forwardly together with the tippler 117 while being rolled forwardly.

Meanwhile, a pallet positioning conveyor 138 is mounted for tilting motion on a travelling frame 139 in front of the tippler 117. The travelling frame 139 has wheels 141 adapted to roll on a pair of horizontally extending rails 140 as shown in FIGS. 19 and 21. A tiltable table 144 is supported for tilting motion at a front end of the travelling frame 139 by way of a pivotal arm 142 and a link 143, and the conveyor 138 is located on the tiltable table 144. The travelling frame 139 and the tiltable table 144 are connected at respective rear ends thereof to each other by means of a hydraulic cylinder 145 acting as a tilting actuator. The tiltable table 144 is normally held in a horizontal position, but when the hydraulic cylinder 145 operates, it is tilted upwardly to tilt the conveyor 138 upwardly in an integral relationship. The conveyor 138 receives thereon a pallet 3 transported thereto by a pallet carrying in conveyor 146 while held in its horizontal position. The pallet 3 received on the conveyor 138 is held from movement on the conveyor 138 even if the conveyor 138 is tilted. The pivotal arm 142 is held in an upwardly inclined position as shown in FIG. 19 when the tiltable table 144 is held in its horizontal position, but if the tiltable table 144 is tilted upwardly, the pivotal arm 142 is pivoted downwardly as seen in FIG. 21. A hook 147 is provided at a free (rear) end portion of the pivotal arm 142 while a stopper 148 is provided projectingly at a base end portion of the pivotal arm 142. Normally, the stopper 148 engages with an engaging recess 149 provided at a predetermined position below the stopper 148 to hold the travelling frame 139 to a predetermined (home) position.

At a position further rearwardly of the travelling frame 139, an advancing and retracting mechanism 150 for moving the travelling frame 139 back and forth is provided. The advancing and retracting mechanism 150 converts rotation of a conveyor advancing and retracting motor 151 into a linear motion by means of a crank 152 in order to slidably move a slide rod 153 back and forth. A projection 153a for engaging with the hook 147 at the end of the pivotal arm 142 is provided at an end (front end) of the slide rod 153. When the travelling frame 139 is held to its home position as shown in FIG. 19, the hook 147 is spaced from the projection 153a because the tiltable table 144 is held in the horizontal position and thus the pivotal arm 142 is inclined upwardly, but if the hydraulic cylinder 145 operates to tilt the tiltable table 144 upwardly, the hook 147 is now engaged with the projection 147a as seen in FIG. 21. After this condition has been reached, as the slide rod 153 is slidably moved, the travelling frame 139 is moved forwardly by a predetermined distance and then backwardly to its original position.

Shock absorbing mechanism 154 for absorbing shocks of the tippler 117 are mounted at rear ends of the left and right frames 116. Each of the shock absorbing mechanisms 154 includes a shock absorbing arm 156 for receiving a pin 155 mounted projectingly on a side face of one of the disks 119 of the tippler 117, and a first shock absorber 157 and a second shock absorber 158 both connected to the shock absorbing arm 156. As the tippler 117 is rolled forwardly to bring its pins 155 into collision with ends of the shock absorbing arms 156, the shock absorbers 157 and 158 absorb possible shocks upon the tippler 117 caused by such collision.

It is to be noted that reference numeral 159 in FIG. 20 denotes a bag stopper in the form of a plate located on the tiltable table 144 and provided for preventing a paper bag 15 to be transferred onto a pallet 3 from dropping therefrom. The stopper 159 can be moved back and forth by cylinders 160.

Figure 24A:
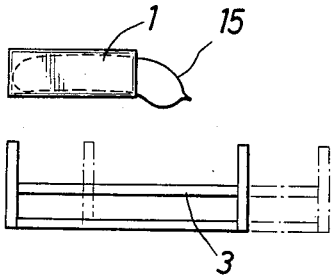
FIGS. 24(A) to 24(H) are schematic illustrations useful in explaining operation of a carrying can and a pallet.

The dumping apparatus 14 having such a construction as described above operates as follows:

When the engaging plates 35 of a predetermined plurality of carrying cans 1 are engaged with the horizontal rods 120 of the tippler 117 as described above and the tippler advancing and retracting motor 136 is activated, the tippler 117 is rolled forwardly while lifting the carrying cans 1. Accordingly, the carrying cans 1 are moved onto a pallet 3 while they are rolled forwardly to direct the openings thereof downwardly as seen in FIG. 24(A). It is to be noted that a broken line in FIG. 24(A) indicates a stopped position of a pallet by a conventional dumping apparatus.

If it is detected by a sensor 161 (FIGS. 19 and 20) that the tippler 117 has been advanced to a predetermined position, the hydraulic cylinder 145 operates to tilt the tiltable table 144 upwardly so that the pallet 3 is inclined as shown in FIG. 24 (B). Simultaneously, the pivotal arm 142 is pivoted downwardly to engage the hook 147 at the end thereof with the projection 153a of the slide rod 153 as shown in FIG. 21. Since the carrying cans 1 are inclined downwardly then, asphalt latex filled therein flows to the low end so that outwardly projected portions of the paper bags 15 from the carrying cans 1 are expanded and depend from the carrying cans 1 and are received on an upper face of the inclined pallet 3. After that, as the conveyor advancing and retracting motor 151 is driven to advance the travelling frame 139 from its home position, the pallet 3 is advanced while kept in the inclined condition as seen from FIG. 24(C). Since also during such advancement the carrying cans 1 are tilted downwardly further, the paper bags 15 therein are gradually transferred into the pallet 3 as if they were pulled out of the carrying cans 1 by the pallet 3.

Figure 24E:
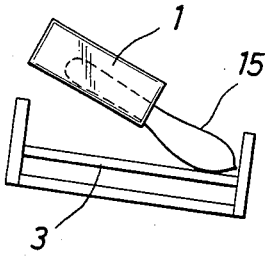
Figure 24B:
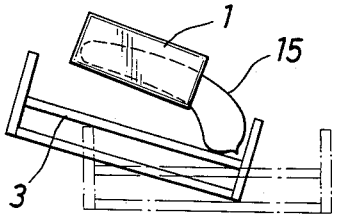
Figure 24F:
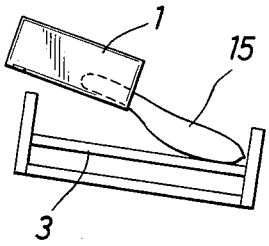
Figure 24C:
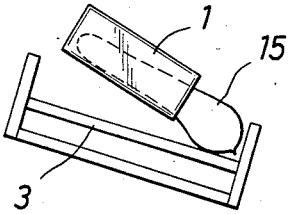
Figure 24G:
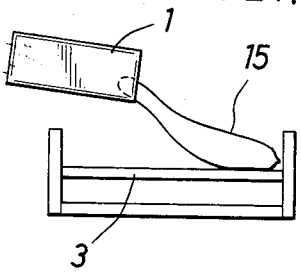
Figure 24D:
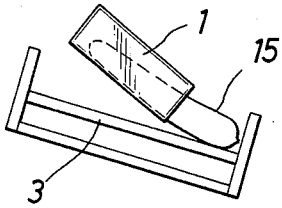
Figure 24H:
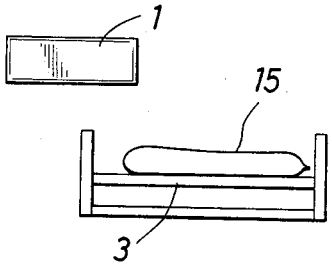

Then, after the travelling frame 139 has reached its advanced limit position, the tippler 117 is rolled backwardly to move the carrying cans 1 while the carrying cans 1 are still held inclined downwardly as shown in FIGS. 24(E) to 24(G). Accordingly, the paper bags 15 are gradually slipped and thus completely pulled out of the carrying cans 1 so that they are transferred onto the pallet 3 as shown in FIG. 24(H). The pallet 3 which has received the predetermined plurality of paper bags 15 thereon in this manner are transferred from the pallet postioning conveyor 138 to and carried out by a pallet carrying out conveyor 162 (FIG. 20) after the travelling frame 139 has been returned to its home position. On the other hand, the carrying cans 1 which have been thus emptied are carried out by a can carrying out conveyor 163 after the tippler 117 has been returned to its home position.

Figure 25:
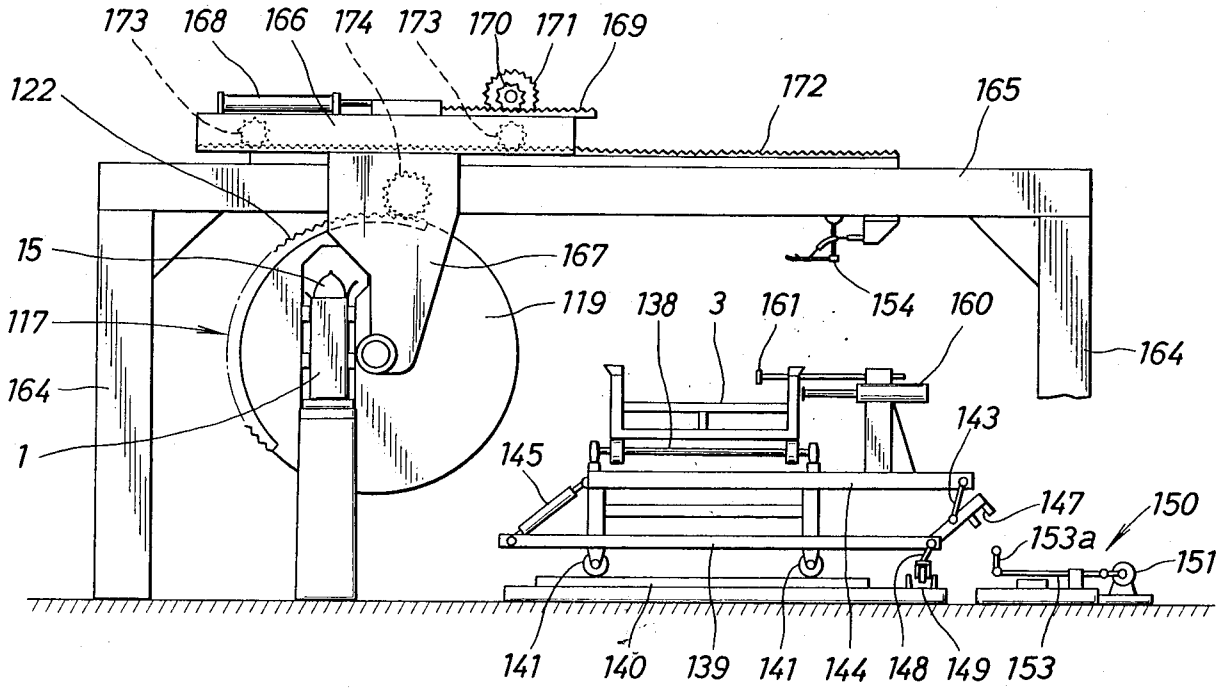
FIG. 25 is a side elevational view of a second embodiment of a dumping apparatus when a tippler is at a home position.
Figure 26:
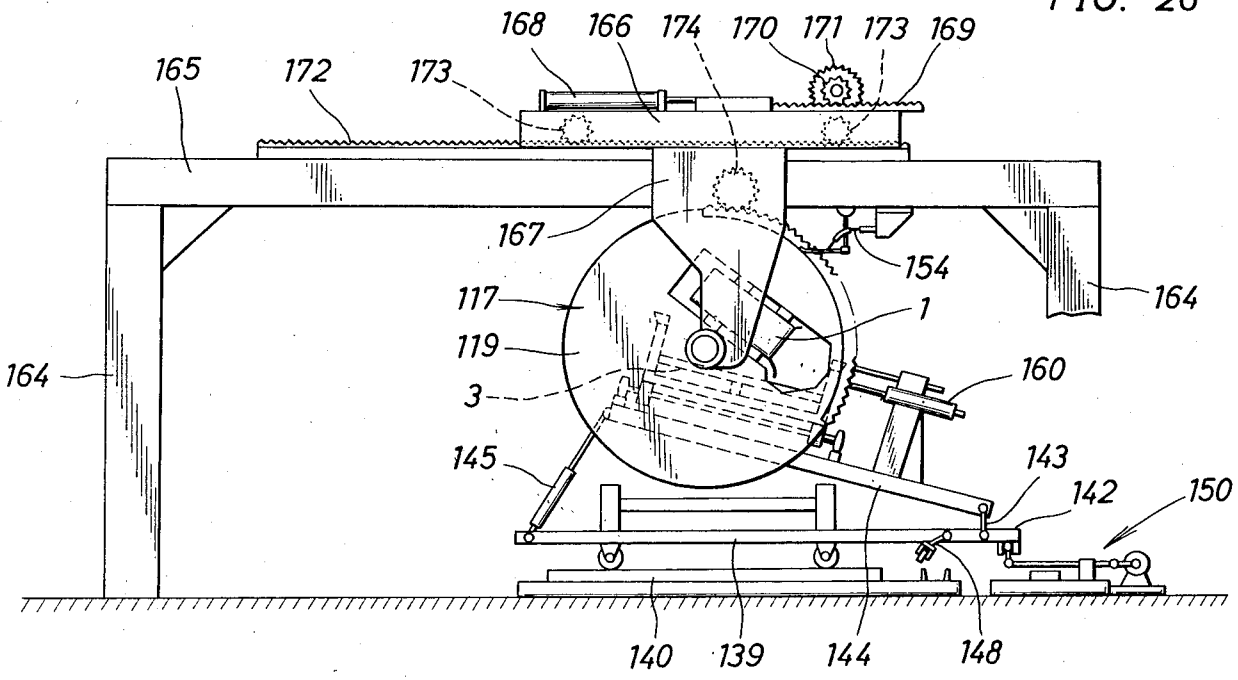
FIG. 26 is a similar view but showing the dumping apparatus when the tippler is at a forward limit position.

FIGS. 25 and 26 illustrate a second embodiment of the dumping apparatus 14. The second embodiment is different in a mechanism for operating the tippler 117 from the first embodiment but is the same as the first embodiment in the other structural features.

In particular, a travelling table 166 is mounted for sliding back and forth movement on a beam 165 extending between a pair of support rods 64, and a tippler 117 is suspended on a pair of bearing plates 167 depending from opposite sides of the travelling table 166, that is, a pair of disks 119 are mounted for rotation on and between the bearing plates 167. The travelling table 166 has therein a tippler advancing and retracting cylinder 168, a rack 169 connected to be moved back and forth by the tippler advancing and retracting cylinder 168, a pinion 170 meshed with the rack 169, a gear wheel 171 coaxial with the pinion 170, another pinion 173 which is meshed with a rack 172 on the beam 165 and is rolled on the rack 172 by rotation of the gear wheel 171 transmitted thereto, and another gear wheel 174 to which rotation of the pinion 173 is transmitted to rotate the disks 119 of the tippler 117. The structure of the dumping apparatus of the second embodiment described above including a mechanism for transmitting rotation of the pinion 173 to the gear wheel 174 is fully disclosed in copending U.S. patent application Ser. No. 878,158 filed on July 25, 1986 by the present applicant under the title "Dumping Apparatus for a Bag Filled with a Molten Material".

Accordingly, if the cylinder 168 operates, the travelling table 166 is advanced to rotate the tippler 117 in a clockwise direction so that paper bags 15 in carrying cans 1 are transferred onto a pallet 3 in a similar manner as in the case of the first embodiment. It is to be noted that in the second embodiment, a shock absorbing mechanism 154 of the tippler 117 is mounted on the beam 165.

Figure 27:
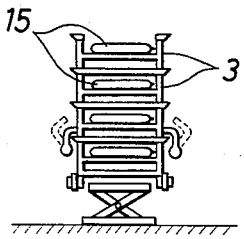
FIGS. 27, 28, 29 and 30 are diagrammatic illustrations of a pallet loader, a pallet unloader, a depalletizer and a palletizer, respectively.
Figure 28:
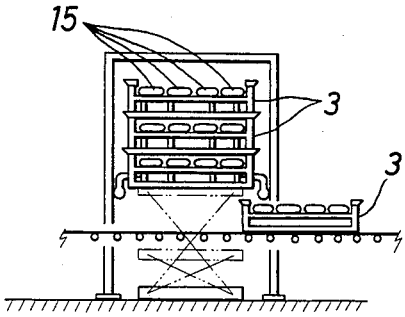
Figure 29:
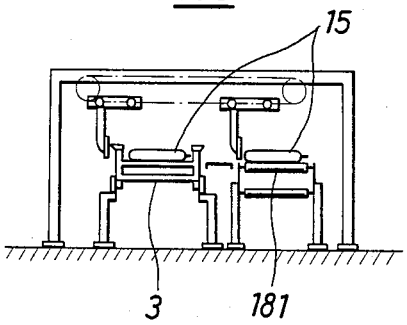
Figure 30:
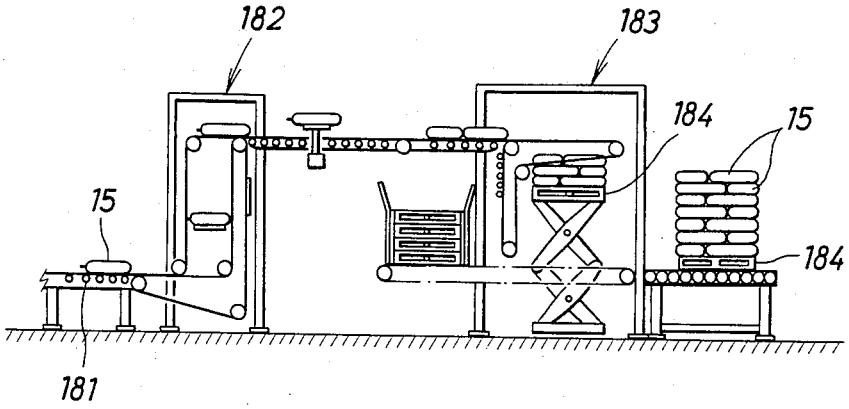

The pallet 3 to which the predetermined plurality of paper bags 15 have been transferred by the dumping apparatus 14 and which has been carried out from the dumping apparatus 14 by the pallet carrying out conveyor 162 is then fed into a pallet loader 176 by a pallet moving device 175 shown in FIG. 1 so that it is heaped up on another pallet 3 thus in a predetermined plurality of stages as shown in FIG. 27. Then, the pallets 3 are fed into the cooling warehouse 5 by way of a turntable 177 shown in FIG. 1, and in the cooling warehouse 5, they are suitably heaped up by another pallet loader 178 and asphalt latex in the paper bags 15 on them is cooled in the cooling warehouse 5. The pallets 3 after cooling of asphalt latex thereof in the cooling warehouse 5 are then fed out from the cooling warehouse 5 while they are held in the heaped up condition in the predetermined plurality of stages, and then they are separated by a pallet unloader 179 as shown in FIG. 28 and fed one by one into a depalletizer 180. The depalletizer 180 transfers paper bags 15 on a pallet 3 onto an asphalt carrying out conveyor 181 as shown in FIG. 29. The paper bags 15 received on the conveyor 181 are then fed to and lifted by an elevator 183 as shown in FIG. 30 and heaped up for shipment on a shipment pallet 184 as shown in FIG. 30 by a palletizer 183. Meanwhile, the thus emptied pallet 3 is again fed to the dumping apparatus 14 for subsequent use by way of a turntable 185 similar to the turntable 177.

What is claimed is:

1. An automatic molten substance bagging system, comprising: a conveyor system providing a substantially closed path for circulating carrying cans adapted to receive bags therein; an automatic bag supply apparatus for supplying a bag into each of the carrying cans; an inflator for automatically opening a mouth of and inflating the bag received in each of the carrying cans; an automatic filling apparatus for filling up the thus inflated bag with a predetermined weight of a molten substance, and filling apparatus including first means for first filling the bag with a fixed volume of the molten substance, the fixed volume corresponding to a majority of the predetermined weight of the molten substance, said filling apparatus further including second means for weighing the bag and for further filling the bag with the molten substance until the predetermined weight of the molten substance is reached; a sealing apparatus for sealing the mouth of the bag filled up with the molten substance; and a dumping apparatus for transferring a plurality of the filled up, sealed bags onto another conveyor system for next processing while leaving the carrying cans on said first-mentioned conveyor system.

2. An automatic molten substance bagging system according to claim 1, wherein the fixed volume corresponds to 90 percent or so of the predetermined weight of the molten substance.

3. An automatic molten substance bagging system according to claim 1, wherein said conveyor system is branched into two conveyor lines at a position between said inflator and said filling apparatus, said conveyor lines being joined into a single conveyor line at a position between said sealing apparatus and said dumping apparatus, said filling apparatus and said sealing apparatus being provided for each of said two conveyor lines.

4. An automatic molten substance bagging system, comprising an automatic filling apparatus which comprises: a fixed volume filling machine including a pair of vacuum attracting members for attracting portions around a mouth of a bag transported thereto by a conveyor to open the mouth of the bag, a volume pouring device having a pouring out portion adapted to be inserted into the mouth of the bag opened by said vacuum attracting members for pouring the molten substance into the bag, a fixed volume device for containing a predetermined fixed amount of the molten substance, and an extruder for extruding the molten substance out of said fixed volume device into said volume pouring device; and a weight filling machine including weighing means for receiving thereon and measuring the weight of the bag contained in the carrying can and filled with the predetermined fixed amount of the molten substance, a weight pouring device for further pouring the molten substance into the bag, and a valve means for stopping such pouring by said weight pouring device when a predetermined weight is measured by said weighing means, wherein said fixed volume device includes a cylinder and said extruder includes a piston fitted for sliding motion within said cylinder and an actuator connected to move said piston back and forth in said cylinder, the interior of said cylinder being divided by said piston into two chambers which can contain the predetermined fixed amount of the molten substance therein, whereby the fixed amount of the molten substance is fed from one of said chambers into said volume pouring device while the other chamber is supplied with the molten substance when said piston is moved in one direction, and on the contrary when said piston is moved in the opposite direction, the one chamber is supplied with the molten substance while the fixed amount of the molten substance is fed from the other chamber.

5. An automatic molten substance bagging system, comprising: an automatic filling apparatus for filling up a bag with a predetermined weight of a molten substance, said filling apparatus including first means for first filling the bag with a fixed volume of the molten substance, the fixed volume corresponding to a majority of the predetermined weight of the molten substance, said filling apparatus further including second means for weighing the bag and for further filling the bag with the molten substance until the predetermined weight of the molten substance is reached, and further comprising a sealing apparatus for sealing a mouth of a bag filled up with the molten substance, and a dumping apparatus which comprises: a pallet conveyor extending over a predetermined transportation range in a transfer station for receiving and conveying a pallet thereon; a tippler for carrying a plurality of carrying cans in each of which a bag filled with the molten substance and sealed at the mouth thereof is contained and for pulling and transferring the plurality of filled up sealed bags from the carrying cans onto the pallet received on said pallet conveyor by moving forwardly to move the carrying cans to a position above the pallet while being rotated to tilt the carrying cans and then by moving back while being rotated back, an advancing and retracting mechanism for advancing and retracting said pallet conveyor in the same directions with said tippler, and a tilting actuator for tilting said pallet conveyor upwardly from its horizontal condition so as to lift a side of said pallet conveyor adjacent said tippler.

6. An automatic molten substance bagging system. comprising: an automatic filling apparatus for filling up a bag with a predetermined weight of a molten substance, said filling apparatus including first means for first filling the bag with a fixed volume of the molten substance, the fixed volume corresponding to a majority of the predetermined weight of the molten substance, said filling apparatus further including second means for weighing the bag and for further filling the bag with the molten substance until the predetermined weight of the molten substance is reached, and further comprising an automatic bag supply apparatus which comprises: a lifter for receiving thereon bags having mouth sides and bottom sides directed in opposite directions for each predetermined plural number of the bags; an attracting and transporting machine for attracting and transporting an uppermost one of the bags received on said lifter and for releasing the bag at a predetermined position;

guide means for guiding a bag released from said attracting and transporting machine into a carrying can in position below; and orienting means for orienting a bag either between said lifter and said attracting and transporting machine or between said attracting and transporting machine and said guide means.

7. An automatic molten substance bagging system according to claim 6, further comprising a sealing apparatus for sealing a mouth of a bag filled up with the molten substance, and a dumping apparatus which comprises: a pallet conveyor extending over a predetermined transportation range in a transfer station for receiving and conveying a pallet thereon; a tippler for carrying a plurality of carrying cans in each of which a bag filled with the molten substance and sealed at the mouth thereof is contained and for pulling and transferring the plurality of filled up sealed bags from the carrying cans onto the pallet received on said pallet conveyor by moving forwardly to move the carrying cans to a position above the pallet while being rotated to tilt the carrying cans and then by moving back while being rotated back, an advancing and retracting mechanism for advancing and retracting said pallet conveyor in the same directions with said tippler, and a tilting actuator for tilting said pallet conveyor upwardly from its horizontal condition so as to lift a side of said pallet conveyor adjacent said tippler.

* * * * *